US006195525B1

(12) United States Patent
Maeyama

(10) Patent No.: US 6,195,525 B1
(45) Date of Patent: Feb. 27, 2001

(54) ELECTROMAGNETIC INDUCTION HEATING DEVICE AND IMAGE RECORDING DEVICE USING THE SAME

(75) Inventor: Ryuichiro Maeyama, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/454,859

(22) Filed: Dec. 7, 1999

(30) Foreign Application Priority Data

Dec. 21, 1998 (JP) ..... 10-363204

(51) Int. Cl.[7] ..... G03G 15/20

(52) U.S. Cl. ..... 399/328; 219/216; 219/618; 347/156; 399/45; 399/307; 399/333

(58) Field of Search ..... 399/307, 328, 399/329, 330, 334, 159, 45; 219/216, 619, 618; 347/156

(56) References Cited

U.S. PATENT DOCUMENTS 5,198,842 * 3/1993 Fujino et al. ..... 347/156 X
5,752,148 * 5/1998 Yoneda et al. ..... 399/329
6,021,303 * 2/2000 Terada et al. ..... 399/328
6,037,576 * 3/2000 Okabayashi et al. ..... 219/619

FOREIGN PATENT DOCUMENTS 7-319312 12/1995 (JP) .
10-301415 11/1998 (JP) .

* cited by examiner

*Primary Examiner*—Sophia S. Chen
(74) *Attorney, Agent, or Firm*—Oliff & Berridge, PLC

(57) ABSTRACT

The electromagnetic induction heating device has a simple construction, holds an object to be heated in a favorable heating condition while effectively suppressing the irregularities of heat generation of the object to be heated, and reduces an energy consumption. The electromagnetic induction heating device which heats the object to be heated provided with at least an electromagnetic induction heat generating layer includes a magnetic core made of magnetic material which is disposed in such a manner that it faces the electromagnetic induction heat generating layer of the object to be heated in an opposed manner, and an exciting coil which is wound around the magnetic core and generates a fluctuation magnetic field which penetrates the electromagnetic induction heat generating layer. A movable core which is capable of moving relative to the object to be heated so as to change the intensity of the fluctuation magnetic field which penetrates the electromagnetic induction heat generating layer is provided to at least a portion of the magnetic core. Furthermore, an image recording device is constructed such that the electromagnetic induction heating device is provided for an image carrying body which corresponds to the object to be heated and fixing unit or a pressure device is disposed at the downstream of the electromagnetic induction heating device.

8 Claims, 18 Drawing Sheets

ELECTROMAGNETIC INDUCTION HEATING DEVICE AND IMAGE RECORDING DEVICE USING THE SAME

BACKGROUND OF THE INVENTION

1. Field of the Invention

This invention relates to an improvement of an electromagnetic induction heating device making use of an electromagnetic induction and an image recording device using such a heating device.

Here, the image recording device is of a type which transfers and fixes an unfixed image carried on an image carrying body to a recording member such as a paper or the like, and to be more specific, it widely includes an electrophotographic recording device, device, an electrostatic recording device, an ionography, and devices which performs forming of an image making use of a magnetic latent image.

2. Description of the Related Arts

Conventionally, this kind of electromagnetic induction heating device has been used as a fixing device of an image recording device.

As such a fixing device, a fixing device which makes the alternating magnetic fluxes of magnetic field generating unit applied to an electromagnetic induction exothermic or heat generating member (a heating roller) and so as to generate heat necessary for heating an unfixed toner image on a recording member such as a paper or the like has been known. The device includes an exciting coil and a magnetic material (core) as magnetic field generating unit, an exciting circuit for supplying electricity to an exciting coil and temperature control unit for controlling the temperature of the electromagnetic induction heat generating member by controlling an output of the exciting circuit (see Japanese laid-open patent publication Hei 10-301415, for example).

Furthermore, a technique in which a plurality of cores are arranged in parallel in a heating roller of the fixing device and an exciting coil is wound around each core so as to change a heat generating region in a rotating shaft direction of the heating roller has been already known (see Japanese laid-open patent publication Hei 7-319312, for example).

In this kind of fixing device, the size of the core must be set approximately corresponding to the maximum heat generating region, in principle, it is extremely difficult to prepare the core having a large size.

This is because that shrinkage percentage of the core is extremely large at the time of manufacturing the core by baking the core for 6 hours at a temperature of 1200° C. after compacting and forming the ferrite powder usually and hence, the assurance of the accuracy of size around 100 mm or the maintenance of the flatness of the flat surface of rectangular parallelepiped having a square of 100 mm becomes extremely difficult.

Accordingly, there has been a technical problem that the distance between the core and the heating roller becomes irregular and hence, irregular heat generation occurs at the time of heating the heating roller.

To solve such a technical problem, in a mode where a plurality of cores are arranged, for example, it is considered that exciting circuits provided for respective exciting coils corresponding to respective cores are individually controlled. In this case, however, basically, the number of the exciting circuits must be equal to the number of the cores and hence, the construction of the control system becomes complicated. Furthermore, the control per se which performs a temperature control of the heating roller by correcting the irregularities of the distance between each core and heating roller becomes extremely cumbersome.

Furthermore, in the fixing device which constitutes this type of electromagnetic induction heating device, toner and a recording member are heated while being nipped together between the heating roller and a pressure roller which faces the heating roller in an opposed manner and hence, a noticeable reduction of the energy consumption cannot be obtained.

Still furthermore, the toner is heated at the pressure contact portion between the heating roller and the pressure roller and hence, the temperature of the toner in a fixing region, that is, in the vicinity of an exit of the pressure contact portion is elevated and hence, there is a technical problem that the offset is liable to occur.

SUMMARY OF THE INVENTION

The present invention has been made in view of the above technical problems and provides an electromagnetic induction heating device which has a simple construction, can maintain a favorable heated condition of an object to be heated by effectively restricting the occurrence of irregularities in heating the object to be heated and can reduce the energy consumption and an image recording device which uses such a heating device.

That is, as shown in FIG. 1(*a*), in an electromagnetic induction heating device 2 which heats an object to be heated 1 which has at least an electromagnetic induction heat generating layer 1*a*, the improvement is characterized in that the heating device 2 includes a magnetic core 3 made of magnetic material which is disposed in an opposed manner toward an electromagnetic induction heat generating layer 1*a* of the object to be heated 1 and an exciting coil 4 which is wound around this magnetic core 3 and generates a fluctuation magnetic field H which penetrates the electromagnetic induction heat generating layer 1*a*, and a movable core 5 which can move relative to the object to be heated 1 and can change the intensity of the fluctuation magnetic field H which penetrates the electromagnetic induction heat generating layer 1*a* is provided to at least a portion of the magnetic core 3.

With such a technical means, the electromagnetic induction heating device 2 of the present invention can heat all objects 1 to be heated which have the electromagnetic induction heat generating layers 1*a*.

Here, the electromagnetic induction heat generating layer 1*a* may preferably be made of any material including conductive metal so long as it generates an eddy current B making use of the fluctuation magnetic field H generated by the magnetic core 3 and generates heat (Joule heat) due to this eddy current B.

The configuration of the object 1 to be heated may be arbitrarily determined in a desired shape such as a belt shape or a drum shape, while with respect to the usage of the object 1 to be heated which has been heated, although the main usage of such an object is to fuse the toner image or the like in an image recording device, there is no problem in using such an object in other devices.

Furthermore, although the magnetic core 3 may have a unitary construction, to adjust the irregularities of heat generation due to the electromagnetic induction heating device 2 more finely, a mode where the magnetic core 3 is divided into a plurality of blocks and a movable core 5 is provided to at least one core block 3*a* is preferable.

Still furthermore, although the exciting coil 4 may be wound around each core block, from a viewpoint that the construction of the exciting circuit which controls the energizing of exciting coil 4 is to be simplified further, the exciting coil 4 is preferably wound around at least two or more core blocks 3*a* while being astride on them.

In this case, winding of the exciting coils 4 is performed by an automatic winding machine thus facilitating the manufacturing of the electromagnetic induction heat generating device.

Still furthermore, although the shape of the magnetic core 3 may be arbitrarily chosen, from a viewpoint that the generated fluctuation magnetic field H is guided and concentrated on the electromagnetic induction heat generating layer 1*a* side of the object 1 to be heated so as to minimize the irradiation of the fluctuation magnetic field H to other portions, the magnetic core 3 should preferably have an E-shaped cross sectional shape which faces and opens toward the electromagnetic induction heat generating layer 1*a* in an opposed manner and the exciting coil 4 is wound around the central core portion.

In such a mode, the peripheral core portions which are formed besides the central core portion function as shield walls which shield the generated fluctuation magnetic field.

Furthermore, the movable core 5 may be formed such that it constitutes a part of the magnetic core 3 or the entire magnetic core 3. That is, all modes of manner of movement of the movable core 5 are allowable so long as the intensity of the fluctuation magnetic field H can be changed in response to the movement.

In particular, in case the magnetic core 3 is composed of a plurality of blocks, the movable core 5 may be provided to the core block which is located at a position corresponding to a region of the object 1 to be heated where the change of the distribution of the heat generation is desired.

Furthermore, as shown in FIG. 1(*b*), the image recording device according to the present invention which uses the above-mentioned electromagnetic induction heating device 2 is characterized by comprising an image carrying body 6 which is provided with an electromagnetic induction heat generating layer 1*a* and conveys an unfixed image T while carrying the unfixed image T thereon, image forming unit 7 which forms the unfixed image T carried on the image carrying body 6, the electromagnetic induction heating device 2 shown in FIG. 1(*a*) which is disposed in an opposed manner to the image carrying body in a direction perpendicular to the moving direction of the image carrying body 6 and fuses the unfixed image T on the image carrying body 6 using an electromagnetic induction heating, and fixing unit 8 which is disposed at a downstream position from a portion of the image carrying body 6 which faces the electromagnetic induction heating device 2 in an opposed manner and transfers and fixes the fused unfixed image T on the image carrying body 6 to a recording member 9.

In such an image recording device, from a viewpoint of making the electromagnetic induction heating device 2 operate corresponding to the size of the recording member 9, as the electromagnetic induction heating device 2, the magnetic core 3 is divided into a plurality of blocks and at least one core block 3*a* is provided with a movable core 5, and the image carrying body 6 is heated by the fixing unit 8 corresponding to the size of the recording member 9 which passes the fixing unit 8.

Furthermore, from a viewpoint that the image carrying body 6 is heated by the electromagnetic induction heating device 2 and the unfixed image T fused by heating can be easily transferred to the recording member 9 side, the image carrying body 6 may preferably include a substrate layer, an electromagnetic induction heat generating layer 1*a* laminated on this substrate layer and a resilient releasing layer laminated on this electromagnetic induction heat generating layer 1*a*.

In this case, the resilient releasing layer may be formed in a mode where the releasing layer is laminated on the surface of the resilient layer or in a mode where the resilient releasing layer per se has the resiliency.

Furthermore, in the above-mentioned image recording device, for example, an intermediate transfer body is used as the above-mentioned image carrying transfer body 6 and a toner image formed on an outer peripheral surface of a photosensitive drum or the like is once transferred onto this intermediate transfer body and then this toner image is heated and fused by the above-mentioned electromagnetic induction heating device 2 and is transferred and fixed to the recording member 9.

Still furthermore, the image carrying body 6 may be used as an image carrier having an outer peripheral surface on which a latent image is formed and developed. In such an image recording device, the electromagnetic induction heat generating layer 1*a* is provided in the vicinity of the peripheral surface of the image carrier, the latent image is directly formed on this peripheral surface, and the toner is transferred from a developing device so as to form a toner image. Subsequently, this toner image is fused by the electromagnetic induction heating device 2 and is transferred and fixed to the recording member 9.

The above-mentioned image carrier may use an insulation material as a member formed on an outer peripheral surface thereof and a latent image is formed by an ion beam irradiation device thus realizing a so-called ionography. Furthermore, the above-mentioned image carrier may include a photosensitive layer on an outer peripheral surface thereof and an image light is irradiated so as to form a latent image thus realizing the xerography. In this case, however, it is necessary to use the photosensitive layer which characteristics is not remarkably changed by heating.

Furthermore, as the fixing unit 8, any unit can be chosen arbitrarily so long as it can bring the unfixed image T fused by the electromagnetic induction heating device 2 into pressure contact with the recording member 9 and can transfer and fix the unfixed image T to the recording member 9.

Accordingly, there is no problem so long as the fixing unit 8 used in the image recording device of the present invention is a so-called pressure device. From a viewpoint that the heating pattern provided by the electromagnetic induction heating device 2 is corrected, the fixing unit 8 may be constructed such that it encases a heat source capable of heating in a range which approximately corresponds to the size of the recording member 9.

Subsequently, the manner of operation of the above-mentioned technical unit is explained.

In the electromagnetic induction heating device 2 shown in FIG. 1(*a*), when the exciting coil 4 is energized, the variable electric field H is generated by the magnetic core 3. This variable electric field H penetrates the electromagnetic induction heat generating layer 1*a* of the object 1 to be heated, and eddy current B is generated in the inside of the electromagnetic induction heat generating layer 1*a* thus generating heat.

In this case, when the movable core 5 moves in a direction away from the electromagnetic induction heat generating layer 1*a*, for example, the intensity of the fluctuation magnetic field H from the magnetic core 3 is changed and in response to such a change, the eddy current B in the electromagnetic induction heat generating layer 1*a* is changed thus changing an amount of heat generation.

Furthermore, in the image recording device shown in FIG. 1(*b*), the fluctuation magnetic field H generated by the electromagnetic induction heating device 2 penetrates the electromagnetic induction heat generating layer 1*a* of the image carrying body 1 and hence, the eddy current B is generated in the inside of this layer 1*a* thus generating heat. Accordingly, the unfixed image T (toner image) on the image carrying body 1 is heated and fused.

The fused toner is brought into pressure contact with the recording member 9 fed from a paper feeder by means of the fixing unit 8 (equivalent to the pressure device). In this case, since the recording member 9 is not heated and thus held at a room temperature, the temperature of the toner which is brought into pressure contact with the recording member 9 is instantly dropped. However, since the toner is sufficiently heated, the fused toner takes in fibers of the recording member 9 and is impregnated between fibers and adhered to the fibers.

Then, during its course of passing a nip portion where the recording member 9 is brought into pressure contact with the image carrying body 6 by means of the fixing unit 8 (pressure device), the temperature of the toner is further lowered and hence, the fluidity of the toner becomes small and the whole amount of the toner is integrally adhered to the recording member 9 at an exit of the nip portion. Accordingly, a so-called offset which is a phenomenon that when the recording member 9 is peeled off from the image carrying conveyng body 6, the toner is separated and a part of separated toner remains on the image carrying body 6 is not generated so that the transfer can be performed at an extremely high efficiency and fixing is simultaneously performed.

As described above, according to this image recording device, the unfixed image T (toner image) is heated and fused by the heat generation of the electromagnetic induction heat generating layer 1*a* and the portion to be heated is constituted by the electromagnetic induction heat generating layer 1*a* in the vicinity of the peripheral surface of the image carrying body 6, the layer formed on the electromagnetic induction heat generating layer 1*a* and the toner and hence, by forming, for example, the substrate layer or the like disposed under the electromagnetic induction heat generating layer 1*a* using material having a small heat conductivity, the toner can be fused with the least heating. Accordingly, the toner can be turned into a fused state in an extremely short time so that energy used can be reduced, an extra heating becomes unnecessary, and it is unnecessary to set a standby time at the time of starting an image forming operation by turning on the power source of this image recording device.

Furthermore, since the fused toner is sufficiently heated, when the fused toner is brought into pressure contact with the recording member 9 in an unheated condition, the fused toner is adhered to this recording member 9 and thereafter heat is taken by this recording member 9 so that the temperature of the fused toner is lowered.

In this case, since only the limited portion on the peripheral side from the electromagnetic induction heat generating layer 1*a* of the image carrying body 6 is elevated to high temperature, the heat quantity held by the toner and the image carrying body 6 is small so that lowering of the temperature rapidly occurs.

Accordingly, by properly setting the width of the nip portion where the recording member 9 is brought into pressure contact with the image carrying body 6, the temperature of the toner at the exit of the nip portion is restricted to a low value thus preventing the occurrence of the offset.

In particular, in the above-mentioned electromagnetic induction heating device 2, in case the magnetic core is separated into a plurality of blocks and a movable core 5 is provided to a given core block, it becomes possible to uniformly heat the necessary heat generating region of the image carrying body 6, that is, a portion of the image carrying body 6 which corresponds to the unfixed image T region and hence, no irregularities of heat generation occurs and no irregularities of luster occurs on the image accordingly.

BRIEF DESCRIPTION OF THE DRAWING

The accompanying drawings which are incorporated in and constitute a part of this specification, illustrate embodiments of the invention and, together with the description, serve to explain the principles of this invention.

DESCRIPTION OF THE PREFERRED EMBODIMENTS

Preferred embodiments of this invention are explained in detail in conjunction with attached drawings.

First Embodiment

Figure 1:
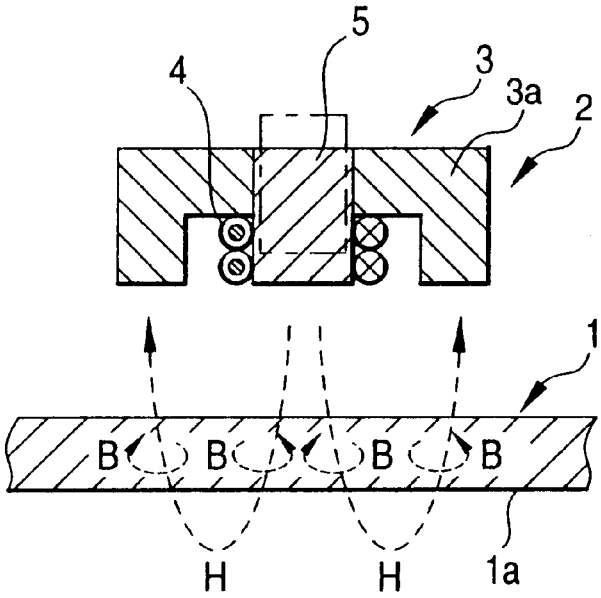
FIG. 1(*a*) is an explanatory view showing a schematic construction of an electromagnetic induction heating device according to the present invention, while FIG. 1(*b*) is an explanatory view showing a schematic construction of an image recording device according to the present invention.
Figure 1:
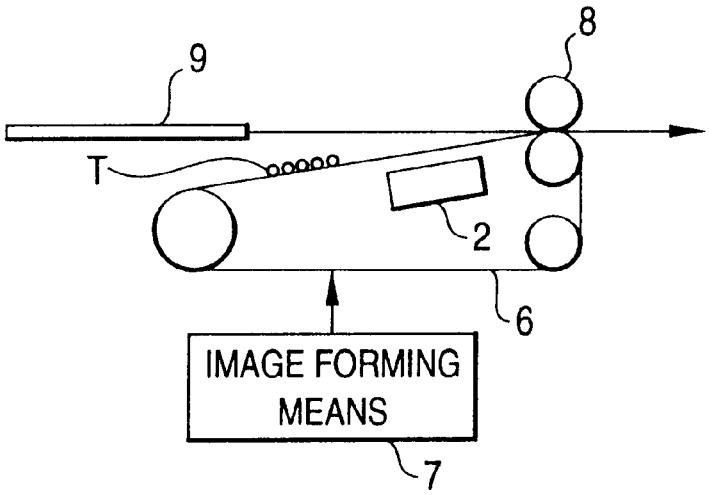
Figure 2:
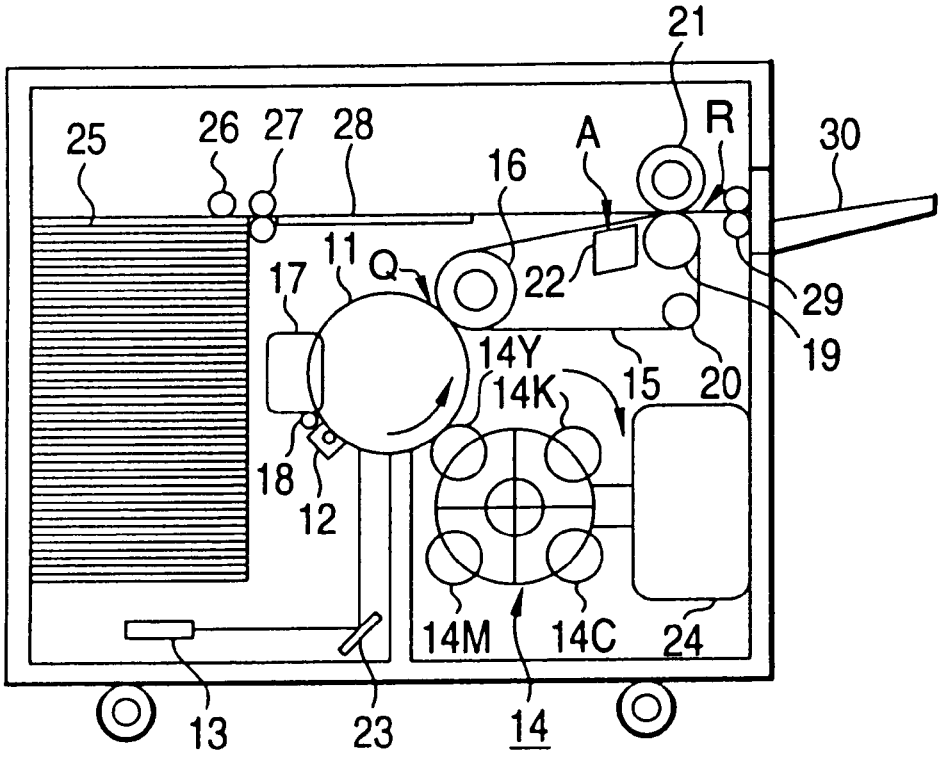
FIG. 2 is an explanatory view showing a schematic construction of an image recording device of the first embodiment.

FIG. 2 is a schematic structural view showing an image recording device according to the first embodiment.

In the drawing, this image recording device is provided with a photosensitive drum 11 which has a surface on which a latent image is formed due to the difference of electrostatic potential. Surrounding this photosensitive drum 11, a charging device 12 which approximately uniformly charges a surface of the photosensitive drum 11, an exposure part made of a laser scanner 13 and a mirror 23 or the like which forms a latent image on the photosensitive drum 11 by irradiating laser beams in response to respective color signals, rotary type developing devices 14 which respectively store toners in four colors consisting of cyan, magenta, yellow and black and visualize the latent image on the photosensitive drum 11 with respective toners, an intermediate transfer belt 15 made of an endless belt which is supported in such a manner that it is capable of performing a circulation movement in a given direction, a primary transfer roller 16 which is disposed in an opposed manner to the photosensitive drum 11 with the intermediate transfer belt 15 sandwiched therebetween and transfers a toner image to intermediate transfer belt 15, a cleaning device 17 which cleans the surface of the photosensitive drum 11 after the transfer operation, and a static eliminating lamp 18 for eliminating the static electricity from the surface of the photosensitive drum 11.

In the inside of the device, the device is further provided with a take-up roller 19 and a driving roller 20 which are disposed in such a manner they expand the intermediate transfer belt 15 together with the primary transfer roller 16, a pressure roller 21 which is disposed corresponding to the take-up roller 19 with the intermediate transfer belt 15 sandwiched between these rollers 19, 21, a paper feed roller 26 and resist rollers 27 which convey recording members stored in the inside of a paper feeder unit 25 one by one, and a recording member guide 28 which feeds the recording member between the intermediate transfer belt 15 wound around the take-up roller 19 and the pressure roller 21.

Furthermore, in a circulating direction of the intermediate transfer belt 15, at the upstream side of the position where the intermediate transfer roller 15 and the pressure roller 21 face each other in an opposed manner, an electromagnetic induction heating device 22 which heats the toner image from the back surface side of the intermediate transfer belt 15 is provided.

The above-mentioned photosensitive drum 11 is formed by providing a photosensitive layer made of OPC or a-Si on the surface of a cylindrical conductive base member which is electrically grounded.

The above-mentioned developing unit 14 is provided with four developing units 14C, 14M, 14Y, 14K which respectively store toners of cyan, magenta, yellow and black and these developing units 14C, 14M, 14Y, 14K are respectively rotatably supported in such a manner that they are capable of facing the photosensitive drum 11 in an opposed manner. In the inside of each developing unit 14C, 14M, 14Y, 14K, a developing roller which forms a toner layer on a surface thereof and conveys the toner layer to a position where the toner layer faces the photosensitive drum 11 in an opposed manner is provided. To this developing roller, a voltage produced by superposing VDC of 400 V to a square wave alternating voltage having an alternating voltage value VP–P of 2 kv and a frequency f of 2 kV Hz is applied and hence, the toner is transferred to the latent image on the photosensitive drum 11 due to an action of the electric field. Furthermore, the toner is supplied to respective developing units 14C, 14M, 14Y, 14K from a toner hopper 24.

Figure 3:
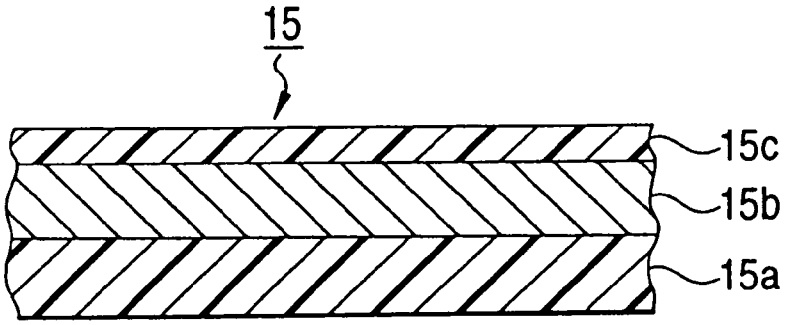
FIG. 3 is a schematic cross sectional view showing the structure of an intermediate transfer belt used in the above-mentioned image recording device.

FIG. 3 is a schematic cross sectional view showing the above-mentioned intermediate transfer belt 15.

This intermediate transfer belt 15 is composed of a base layer 15*a* which is made of a sheet-like member having a high heat resistance, a conductive layer (electromagnetic induction heat generating layer) 15*b* laminated on the base layer 15*a*, and a surface releasing layer 15*c* which constitutes an uppermost layer.

The base layer 15*a* may preferably be a semiconductive member having a thickness of 10 $\mu$m–100 $\mu$m and may be preferably made of material produced by dispersing conductive material such as carbon black or the like into resin having a high heat resistance as represented by, for example, polyester, polyethylene terephthalate, polyethersulfone, polyether-ketone, polysulfur, polyimide, polyimideamide, polyamide or the like. The conductive material is dispersed into the base layer 15*a* in view of the electrostatic transfer ability to transfer the toner image by applying the electric field during the primary transfer operation. The construction of the base layer, however, is not limited to such a construction.

The conductive layer 15*b* has a thickness of 0.05 $\mu$m–50 $\mu$m and is made of a layer made of iron or cobalt or a metal layer formed of nickel, copper or chromium formed by plating. The detail of the conductive layer 15*b* is explained later.

The surface releasing layer 15*c* is preferably made of a sheet or a coated layer having a thickness of 0.1 $\mu$m–30 $\mu$m which has a high releasing ability. For example, it is made of tetrafluoroethylene-par-fluoroalkylvinylether copolymer, polytetrafluoroethylene-silicone copolymer or the like. Since the toner is brought into contact with this surface releasing layer 15*c*, material thereof gives a large influence to the image quality. In case material of the surface releasing layer 15*c* is made of a resilient member, the toner is brought into close contact with the surface releasing layer 15*c* in such a manner that it embraces the toner and hence, the deterioration of the image is minimized and the luster of the image is made uniform. In case the releasing material is made of material having no resiliency such as resin, however, it is difficult to bring the toner into complete contact with the recording member at the pressure contact portion with the intermediate transfer belt 15 so that the insufficient transfer and fixing or the irregularities of the luster of the image are liable to occur.

In particular, this phenomenon is apparent in case of the recording member having a large surface roughness.

Accordingly, material of the surface releasing layer 15*c* should preferably be a resilient body. In case resin is used as the material of the surface releasing layer 15*c*, it is preferable that a resilient layer is interposed between the surface releasing layer 15*c* and the conductive layer 15*b*. To achieve a toner embracing effect, in all cases, the thickness of the resilient body is set to 10 $\mu$m, and preferably not less than 20 $\mu$m.

The above-mentioned intermediate transfer belt 15 performs a circulatory movement driven by the driving roller 20 and hence, the pressure contact portion of the intermediate transfer belt 15 with the pressure roller 21 moves at the same speed as the recording member along with the rotation of the driving roller 20.

Here, the width of the nip and the moving speed of the recording member are set such that the time that the recording member is present in the nip defined between the pressure roller 21 and the intermediate transfer belt 15 becomes 10 ms–50 ms. By restricting the time that the recording member is present in the nip, that is, the period from the time that the fused toner is pressed to the recording member to the time that the recording member is peeled off from the intermediate transfer belt 15 is not more than 50 ms, even when the toner is heated to a sufficient temperature to be adhered to the recording member, the temperature of the toner is lowered to the level which causes no offset at the exit of the nip.

Figure 4:
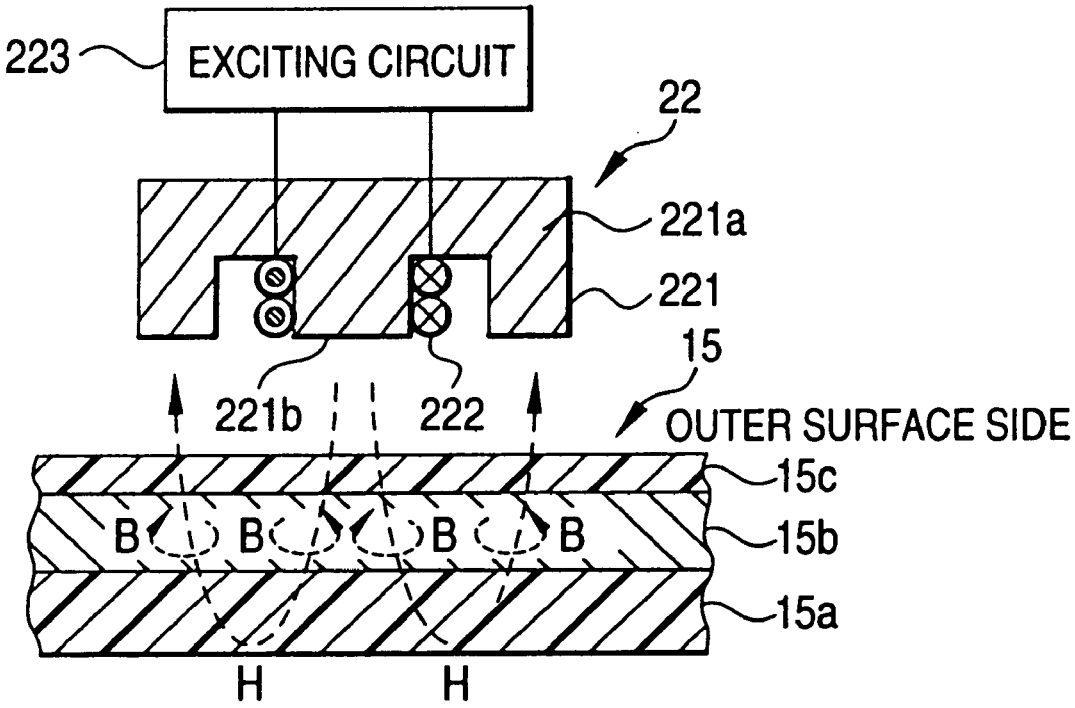
FIG. 4 is an explanatory view showing the heating principle of the intermediate transfer belt of the electromagnetic induction heating device.

FIG. 4 is an explanatory view explaining the heating principle of the intermediate transfer belt 15 by the electromagnetic induction heating device 22.

As shown in FIG. 4, an essential part of the above-mentioned electromagnetic induction heating device 22 is comprised of an iron core (equivalent to magnetic core) 221 having a downwardly directed E-shaped cross section (opening toward the intermediate transfer belt 15 side), an exciting coil 222 wound around a central core portion 221*b* of this iron core 221, and an exciting circuit 223 which applies an alternating current to this exciting coil 222. Peripheral core portions 221*a* of the iron core 221 form shield walls which prevent the generating magnetic flux (the fluctuation magnetic field) from irradiating to locations other than opening portions.

Here, upon applying of the alternating current to the exciting coil 222, as shown in FIG. 4, the generation and extinction of the magnetic flux indicated by an arrow H are repeated around the exciting coil 222. The electromagnetic induction heating device 22 is arranged in such a manner that the magnetic flux H traverses the conductive layer 15*b* of the intermediate transfer belt 15.

When the fluctuation magnetic field traverses the conductive layer 15*b*, an eddy current is generated in the inside of the conductive layer 15*b* in a direction of an arrow B so as to generate a magnetic field which prevents the change of the former magnetic field. Due to the skin effect, this eddy current B substantially is concentrated on and flows through the surface of the exciting coil 222 side of the conductive layer 15*b* and generates heat in proportion to the skin resistance Rs of the conductive layer 15*b*.

Here, assuming that the angular frequency is $\omega$, the magnetic permeability is $\mu$ and the fixed resistance is $\rho$, the skin depth $\delta$ is expressed by a following equation (1).

$$\delta = \sqrt{\frac{2\rho}{\omega\mu}}$$

Furthermore, the skin resistance Rs is expressed by a following equation (2).

$$Rs = \frac{\rho}{\delta} = \sqrt{\frac{\omega\mu\rho}{2}}$$

Still furthermore, the electric power P which is generated in the conductive layer 15*b* of the intermediate transfer belt 15 can be expressed by the following equation (3) provided that the current which flows through the intermediate transfer belt 15 is set to If.

$$P = Rs\int |If|2dS$$

Accordingly, by increasing the skin resistance Rs or increasing the current If which flows through the intermediate transfer belt 15, the electric power P can be increased and the heat quantity can be increased. The skin resistance Rs can be increased by increasing the frequency $\omega$ or by using material having a high magnetic permeability $\mu$ or material having a high fixed resistance $\rho$.

In view of the above-mentioned heating principle, although it is estimated that heating becomes difficult when a non-magnetic metal is used as the conductive layer 15*b*, in case the thickness t of the conductive layer 15*b* is thin due to its skin depth $\delta$, the skin resistance Rs is expressed by a following equation (4) so that heating becomes possible.

$$Rs \approx \rho/t$$

Furthermore, it is preferable that the frequency of the alternating current applied to the exciting coil 222 is set to 10–500 kHz. When the frequency becomes equal to or more than 10 kHz, an absorption efficiency of the conductive layer 15*b* is improved, while so long as the frequency is held within the 500 kHz, the exciting circuit 223 can be incorporated using inexpensive elements. Furthermore, when the frequency becomes equal to or more than 20 kHz, it exceeds the audible range so that no sound is generated at the time of energizing, while when the frequency is not more than 200 kHz, a loss caused by the exciting circuit 223 can be minimized and the radiation of noise to the surroundings can be also minimized.

Furthermore, when the alternating current having a frequency of 10–500 kHz is applied to the conductive layer 15*b*, the skin depth is approximately several $\mu$m–several hundreds $\mu$m. Actually, when the thickness of the conductive layer 15*b* is set to less than 1 $\mu$m, substantially no electromagnetic energy is absorbed by the conductive layer 15*b* and hence, the energy efficiency is deteriorated. Furthermore, there also arises a problem that the leaked magnetic field heats other metal portions.

On the other hand, when the thickness of the conductive layer 15*b* exceeds 50 $\mu$m, the heat capacity of the intermediate transfer belt 15 is increased excessively and hence, heat is transmitted by the thermal conduction in the conductive layer 15*b* thus giving rise to a problem that it is difficult to warm the surface releasing layer 15*c*. Accordingly, it is preferable that the thickness of the conductive layer 15*b* is set to 1 $\mu$m–50 $\mu$m.

Furthermore, to increase the heat generation at the conductive layer 15*b*, the current If which flows through the intermediate transfer belt 15 should be increased and the increase of the current If is achieved by intensifying the magnetic flux generated by the exciting coil 222 or by increasing the change of the magnetic flux. As specific methods, the number of winding of the exciting coil 222 is increased or the iron core 221 of the coil 222 is made of material such as ferrite or permalloy having a high magnetic permeability and a low residual flux density.

Furthermore, when the resistance value of the conductive layer 15*b* is too small, the heat generating efficiency at the time of generating the eddy current is worsened and hence, the fixed volumetric resistivity of the conductive layer 15*b* in an environment of 20° C. should preferably be not less than 1.5 $10^{-8}$ Ωcm.

In this embodiment, although the conductive layer 15*b* is formed by a plating processing or the like, the layer 15*b* may be formed by a vacuum deposition method, a sputtering: method or the like. Using such methods, the conductive layer 15*b* can be formed of aluminum or a metal oxide alloy which cannot be subjected to the plating processing. In the plating processing, however, it is easy to obtain a given film thickness, that is, a layer thickness of 1 μm–50 μm, the plating processing is desirable.

Furthermore, as the material of the conductive layer 15*b*, a ferromagnetic material such as iron, cobalt, nickel having a high magnetic permeability can be used. In this case, the electomagnetic energy generated by the exciting coil 222 is easily absorbed and hence, the conductive layer 15*b* is efficiency heated.

Still furthermore, among the above-mentioned ferromagnetic material, it is optimal to choose the material having a high resistivity since such material decreases the leakage of magnetism to the outside of the device and lowers the influence to peripheral devices. The conductive layer 15*b* is not limited to metal and the conductive layer 15*b* may be formed by dispersing particles or whiskers which are conductive and have a high magnetic permeability into an adhesive agent for adhering the substrate layer 15*a* having a low thermal conductivity and the surface releasing layer 15*c*. For example, particles made of manganese, titanium, chromium, iron, copper, cobalt, nickel or the like, or particles or whiskers made of ferrite or an oxide which are alloys of the above-mentioned particles, or conductive particles made of carbon black or the like are mixed and dispersed into an adhesive agent so as to form the conductive layer.

Figure 5:
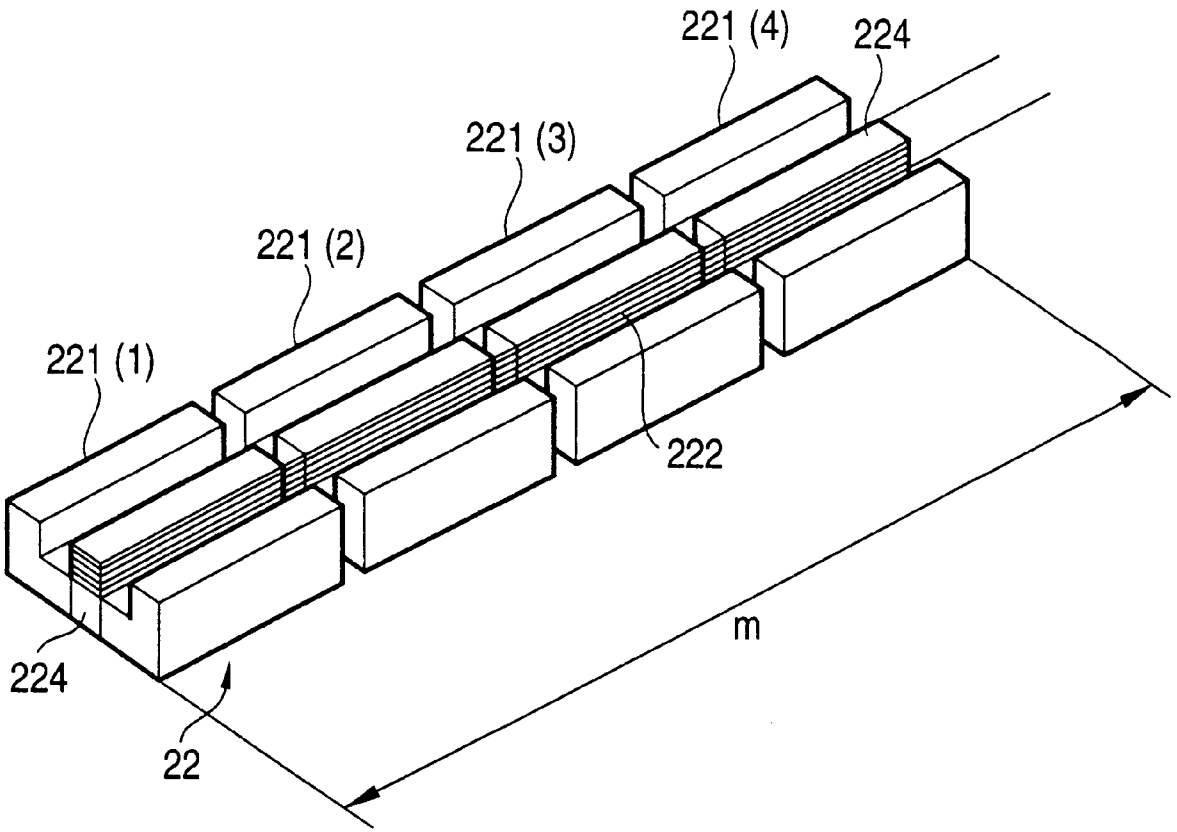
FIG. 5 is an explanatory view showing the detail of the electromagnetic induction heating device used in the second embodiment.

Still furthermore, in this embodiment, as shown in FIG. 5, the electromagnetic induction heating device 22 is constructed such that the iron core (magnetic core) 221 which constitutes magnetic field generating unit is divided into a plurality (four in this embodiment) of blocks 221(1)–(4) within a given size m (approximately corresponding to the width size of the intermediate transfer belt 15: 320 mm in this embodiment) in a direction which intersects the longitudinal direction, that is, the moving direction of the intermediate transfer belt 15.

Figure 6:
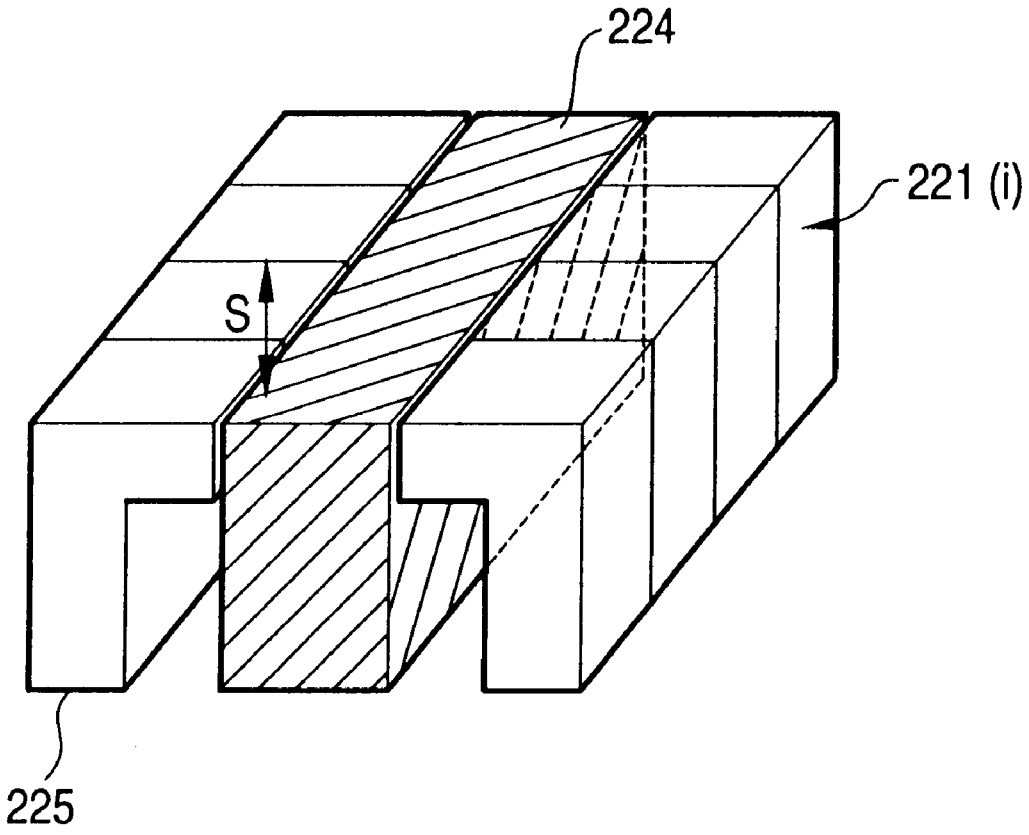
FIG. 6 is an explanatory view showing the basic construction of the core block.

Among these core blocks 221(1)–221(4), as shown in FIG. 6, the core blocks 221(*i*)(i=1, 4) which are positioned at both ends are respectively comprised of a central core portion where the magnetic flux is concentrated and peripheral core portions positioned at back surface sides of the central portion, wherein these core portions are formed as rectangular parallelepiped movable cores 224 which are movable in frontward and backward directions independently. In this embodiment, an amount of movement 's' of the movable core 224 in a frontward and backward direction is set to approximately 4 mm, for example.

On the other hand, the central-side core blocks 221(2) and 221(3) are not provided with movable cores and have a fixed shape with an E-shaped cross section.

Although the core blocks 221(1)–221(4) may be formed of a unitary piece, as shown in FIG. 6, if there were any restrictions in terms of manufacturing, the core blocks may be formed of a plurality of pieces 225 by joining them.

Figure 7:
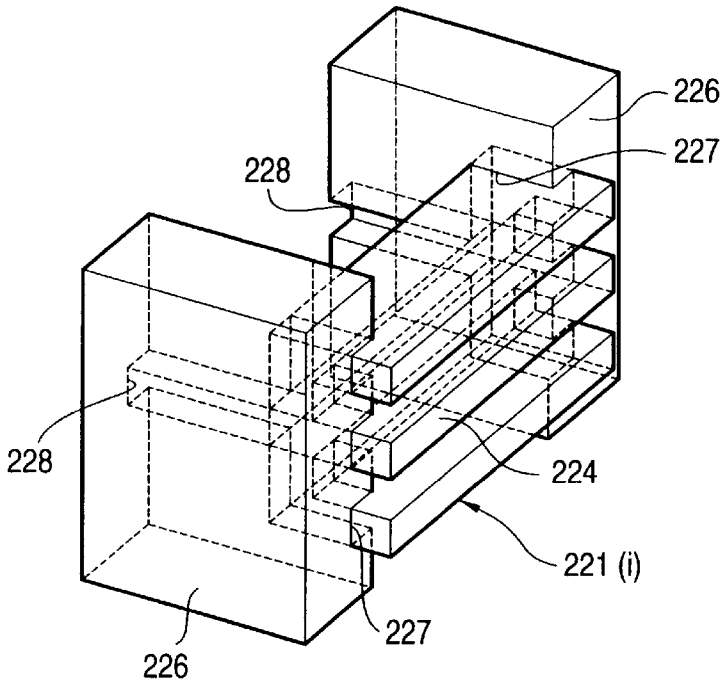
FIG. 7(*a*) is an explanatory view showing one example of a core block supporting structure, while FIG. 7(*b*) is an explanatory view showing a moving condition of a movable core of a core block.
Figure 7:
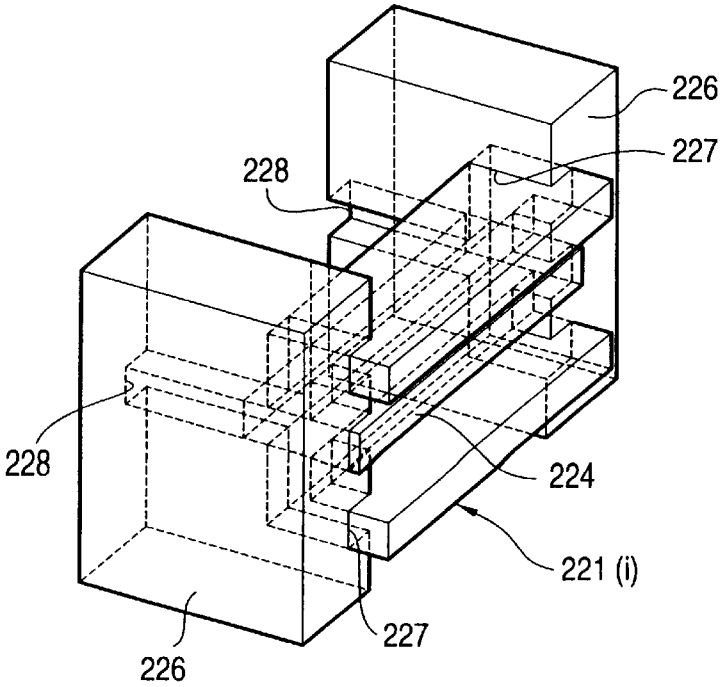

Furthermore, as shown in FIG. 7(*a*) and FIG. 7(*b*), the supporting structure of the core blocks 221(*i*) (i=1, 4) which are disposed at both ends of the magnetic core is constructed such that guide members 226 are provided at both ends of the core block 221(*i*), positioning grooves 227 into which the core block 221(*i*) having the E-shaped cross section is fitted are formed in the inner surface sides of these guide members 226, slide grooves 228 in which the movable cores 224 slide in frontward and backward directions are also formed in the inner surface sides of these guide members 226. Due to such a construction, for example, the movable core 224 can be moved to a retracted position shown in FIG. 7(*b*) from a normal set position (see FIG. 7(*a*)) by retracting the movable core 224 in a slidable manner by way of slide grooves 228.

Figure 8:
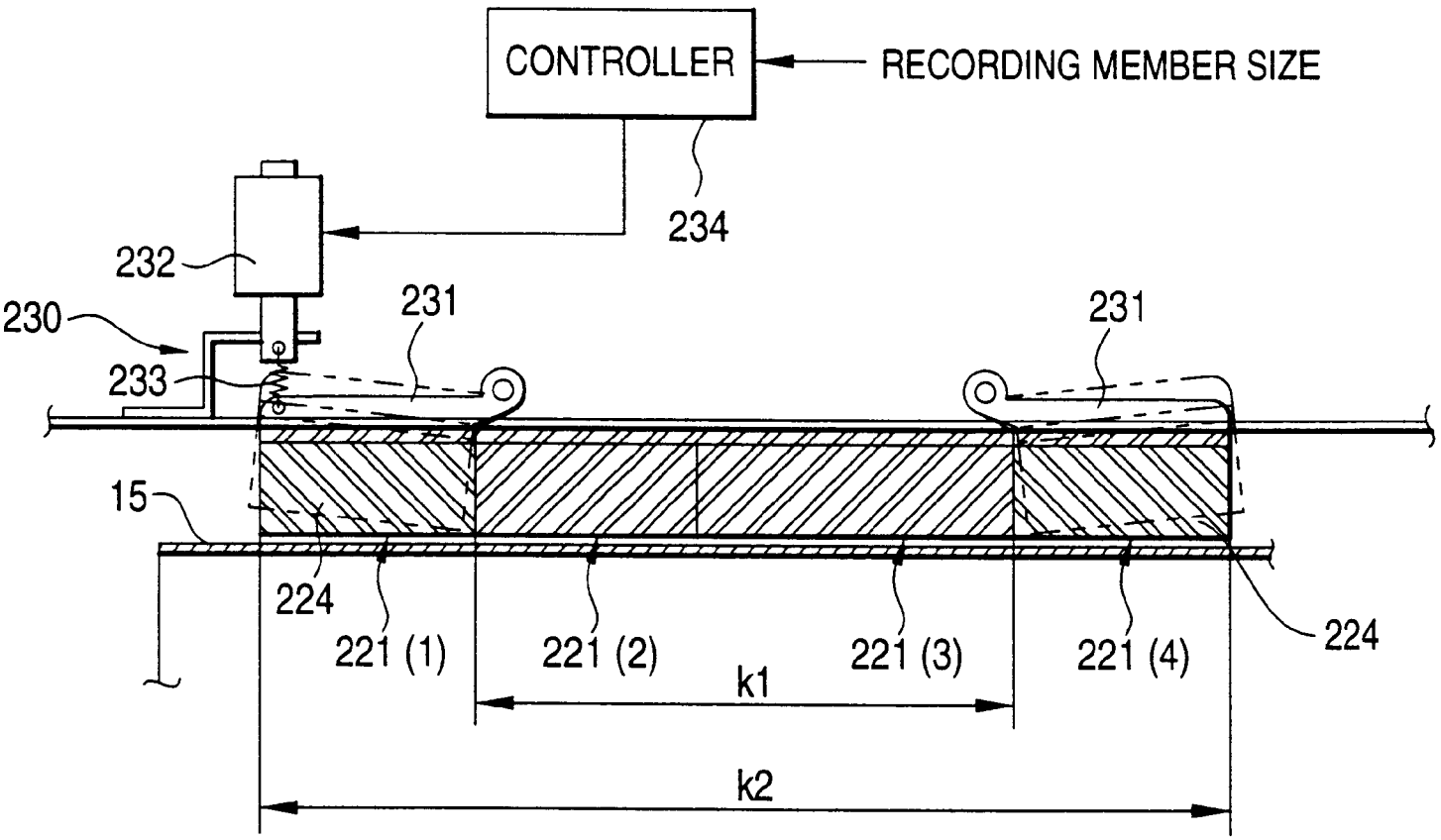
FIG. 8 is an explanatory view showing an example of a drive mechanism of the movable core.

Furthermore, a drive mechanism 230 of the movable core 224 is constructed as shown in FIG. 8, for example. That is, the movable core 224 of the above-mentioned core block 221(1) or 221(4) has a back surface thereof supported by a tilting arm 231 which has a fulcrum at a center-side end thereof, and each tilting arm 231 is tilted directly or by way of a link mechanism not shown in drawings by an actuator 232 such as a solenoid, whereby the movable core 224 is tilted and retracted thus preventing the concentration of the magnetic flux. In the drawing, numeral 233 indicates a return spring which returns the movable core 224 to a set position upon releasing the actuator 232.

According to this mode, a controller 234 takes in the size of a recording member as signals and in case the size of the recording member is the bisected small size (k1: equivalent to the size which is sufficient for a heat generating region corresponding to the center-side core blocks 221(2), 221(3)), a driving signal which retracts the movable core 224 of the core block 221(1) or 221(4) is supplied to the actuator 232, while in case the size of the recording member is the large size (k2: equivalent to the size which corresponds to a heat generating region corresponding to all core blocks 221(1)–221(4)), no driving signal which retracts the movable core 224 of the core block 221(1) or 221(4) is supplied to the actuator 232 so that respective movable cores blocks 224 are being held at the normal set position.

The driving mechanism 230 of the movable core 224 is not limited to the mode shown in FIG. 8 and there is no restriction in selecting other proper driving mechanism.

Figure 9:
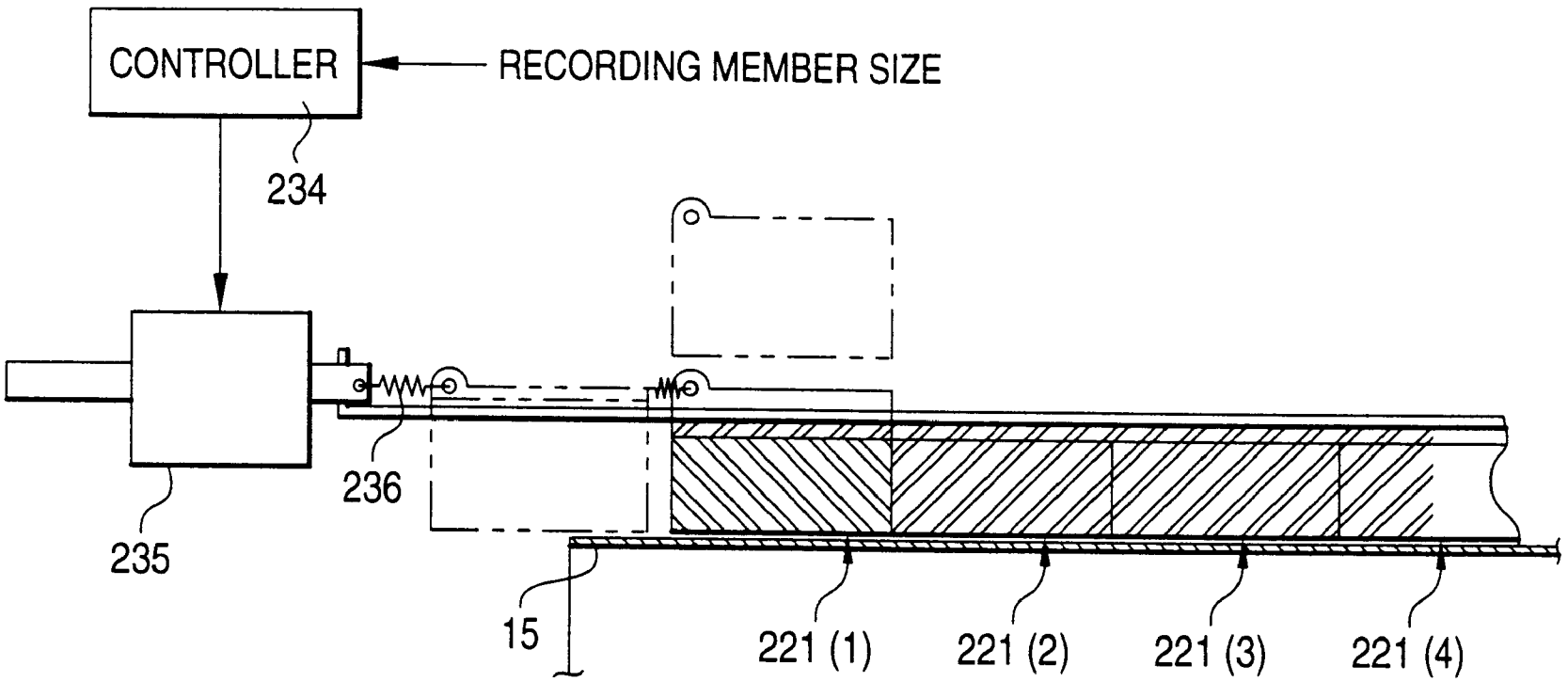
FIG. 9 is an explanatory view showing another example of a drive mechanism of the movable core.

For example, the driving mechanism of the movable core 224 may be constructed as shown in FIG. 9. That is, in the case of heating the recording member of the small size, the movable core 224 of the coreblock 221(1) (or coreblock 221(4)) is retracted toward a horizontal retracted position along the surface of an intermediate transfer belt 15 by means of an actuator 235 such as a solenoid or toward a vertical retracted position (shown in a phantom line in FIG. 9) so as to obviate the concentration of the magnetic flux, while upon releasing the actuator 235, the movable core 224 returns to the original set position by means of a return spring 236. Accordingly, based on determinations executed in the controller 234, the movement control of the movable core 224 is properly performed.

Figure 10:
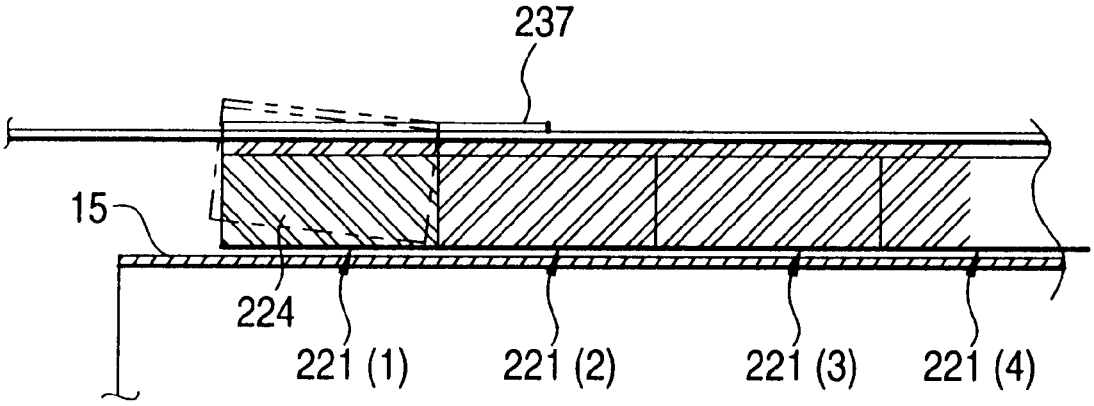
FIG. 10 is an explanatory view showing still another example of a drive mechanism of the movable core.

Furthermore, the driving mechanism of the movable core 224 maybe constructed as shown in FIG. 10, wherein an automatic thermal actuator 237 such a bimetal or a shape memory alloy which changes its behavior by heat is used. For example, in case the recording member of the small size is passing through the core blocks 221(1)–221(4), the generated heat quantity at portions of the intermediate transfer belt 15 corresponding to the core blocks 221(1) and 221(4) which are disposed at both ends becomes higher than that of paper passing portion of the intermediate transfer belt 15. Accordingly, in this driving mechanism, at a point of time that the generated heat quantity exceeds a given generated heat quantity, the automatic actuator 237 is driven so as to automatically retract the movable core 224 of the core blocks 221(1) and 221(4).

With this mode, the determination of the controller 234 becomes unnecessary and hence the control becomes more simplified.

Still furthermore, the movable core 224 is divided into a plural elements thus further narrowing respective heat generating regions and a control similar to the above-mentioned control can be performed on them.

The manner of operation of the image recording device having the above-mentioned construction is hereinafter explained.

The photosensitive drum 11 is rotated in a direction of arrow shown in FIG. 2. The photosensitive drum 11 is substantially uniformly charged by the charging device 12 and thereafter laser beams which have the pulse width modulated in response to yellow image signals from the original are radiated to the photosensitive drum 11 from the laser scanner 13 so that an electrostatic latent image corresponding to the yellow image is formed on the photosensitive drum 11. This electrostatic latent image for the yellow image is developed by the yellow developer 14Y which is preliminarily fixedly mounted to the developing position by means of the rotary type developing device 14 and hence, the yellow toner image is formed on the photosensitive drum 11.

This yellow toner image is electrostatically transferred onto the intermediate transfer belt 15 due to an action of the primary transfer roller 16 at a primary transfer portion Q which constitutes the contact portion between the photosensitive drum 11 and the intermediate transfer belt 15. This intermediate transfer belt 15 is circulatory moved synchronously with the photosensitive drum 11 and this circulatory movement of the intermediate transfer roller 15 is continued while holding the yellow toner image on the surface thereof so as to prepare for the transfer of the magenta image which is a color next to come.

On the other hand, the photosensitive drum 11 has its surface cleaned by the cleaning device 17 and again is substantially uniformly charged by the charging device 12 and laser beams are irradiated from the laser scanner 13 in response to succeeding magenta image signals.

The rotary developing device 14 is rotated while an electrostatic latent image for magenta is formed on the photosensitive drum 11 and the magenta developing unit 14M is fixedly positioned at the developing position so as to perform the developing with the magenta toner. The magenta toner image formed in this manner is electrostaticlly transferrred onto the intermediate transfer belt 15 at the primary transfer portion Q.

Subsequently, the above-mentioned process is performed on cyan and black respectively, and when the transfer of four colors onto the intermediate transfer belt 15 is completed or in the midst of transferring of black which is the last color, the recording member (paper) stored in the inside of the paper feeding unit 25 is fed by means of the paper feed roller 26 and is conveyed to a secondary transfer portion R of the intermediate transfer belt 15 by way of the resist roller 27 and the recording member guide 28.

On the other hand, the toner image in four colors transferred onto the intermediate transfer belt 15 passes through a heating region A which faces the electromagnetic induction heating device 22 in an opposed manner at the upstream of a secondary transfer portion R. In the heating region A, the alternating current is applied from the exciting circuit 223 to the exciting coil 222 so as to make the conductive layer **15*b* of the intermediate transfer belt 15 generate heat due to the electromagnetic induction heating. Accordingly, the conductive layer 15*b* is rapidly heated and this heat is transmitted to the surface layer with the lapse of time and the toner on the intermediate transfer belt 15** is in a fused state at the time of arriving at the secondary transfer portion R.

The toner image fused on the intermediate transfer belt 15 is brought into close contact with the recording member due to the pressure of the pressure roller 21 which is compressed to the intermediate transfer belt 15 in an interlocking manner with conveying of the recording member at the secondary transfer portion R. In the heating region A, the intermediate transfer belt 15 has only a portion thereof disposed in the vicinity of its surface partially heated so that the fused toner comes into contact with the recording member of a room temperature and is rapidly cooled. That is, when the fused toner passes through the nip of the secondary transfer portion R, the toner is instantly impregnated into the recording member and is transferred and fixed due to the heat energy that the toner holds and the contact pressure force, and then the recording member is transferred to the exit of the nip while taking heat away from the toner and the intermediate transfer belt 15 which has only a portion thereof disposed in the vicinity of its surface partially heated. Here, by properly setting the nip width and the moving speed of the recording member, the temperature of the toner at the exit of the nip becomes lower than the softening point temperature. Accordingly, the cohesive force of the toner is increased and the toner image is substantially completely and directly transferred and fixed onto the recording member without causing an offset.

Thereafter, the recording member to which the toner image is transferred and fixed is discharged onto the discharge tray 30 by way of the discharge roller 29 thus completing the formation of the full color image.

The softening point temperature of the above-mentioned toner is obtained using the following method.

The flow tester CFT-500 A type (manufactured by Shimazu seisakusho) is used. The diameter of the die (nozzle) is set to 0.2 mm and the length of the die is set to 1.0 $cm^2$. The cross sectional area of the plunger is set to 1.0 cm2 and as the toner which constitutes a test piece, a minute toner particle having a weight of 1–3 g which is measured accurately is used. An extruding load of 20 kg is applied to the toner and is preliminarily heated at an initial temperature of 70° C. for 300 seconds and then is heated at an equal temperature elevation speed of 6° C./min and an amount of fused toner flowed out from the die (nozzle) is measured. Here, a curve which shows the relationship between an amount of descending of plunger and temperature is obtained and such a curve (hereinafter called as S curve) is depicted in FIG. 11.

Figure 11:
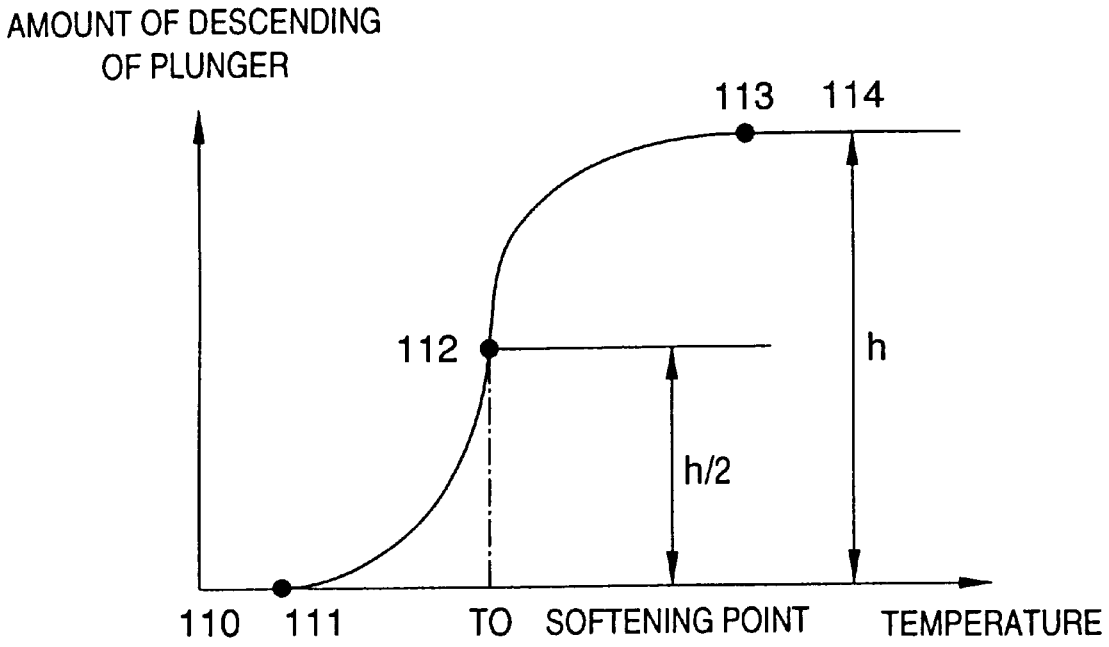
FIG. 11 is an explanatory view showing the measuring method of a softening point of a toner used in the image recording device.

As shown in FIG. 11, the toner is gradually heated corresponding to the elevation of temperature at the equal elevation speed and the flow-out of the toner is started (plunger lowered 110→111). When the temperature of the toner is elevated further, a large amount of toner in a fused state is flowed out (plunger lowered from 111→112→113), and substantially the whole toner is flowed out and lowering of the plunger is stopped (113→114). The height h of the softening S-curve indicates the total flow-out amount. The temperature T0 corresponding to the point 112 where an amount of toner flowed out becomes ½ of the total amount, that is, H/2 is determined as the softening point temperature of the toner.

Figure 12:
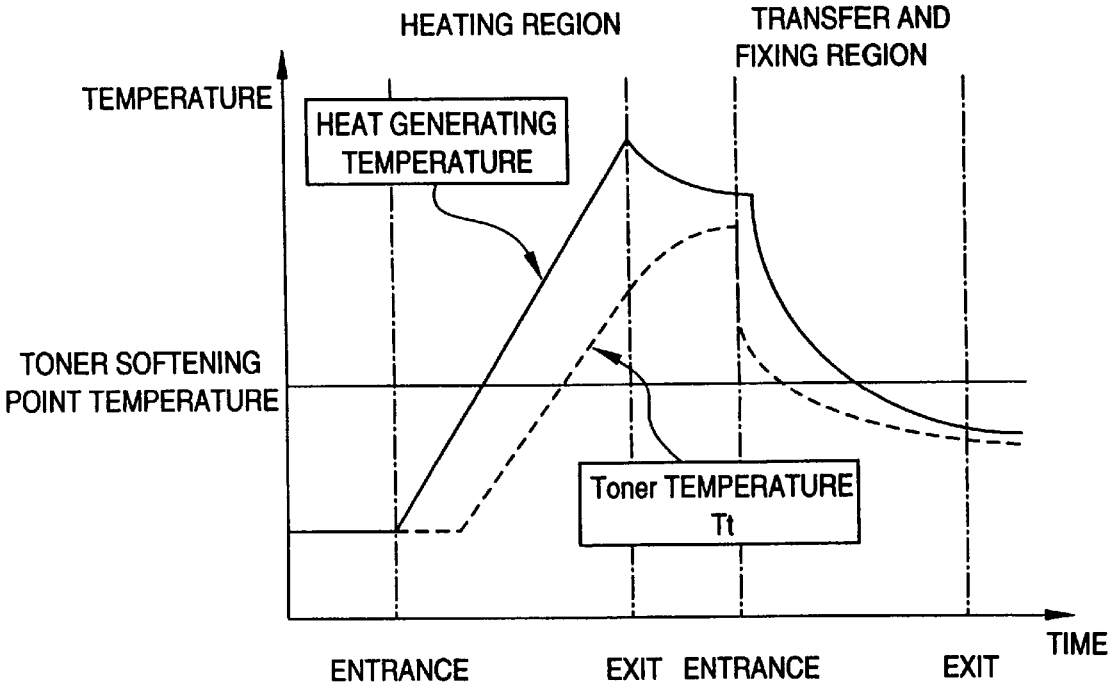
FIG. 12 is an explanatory view showing the temperature change of the toner in the heating region and the transfer and fixing region of the image recording device.

FIG. 12 is a graph showing the temperature change of the toner and the conductive layer (heat generating layer) 15*b* from a point of time that the intermediate transfer belt 15 is just about to pass through the heating region to a point of time that the intermediate transfer belt 15 has passed through the exit of the transfer and fixing region (the nip of the secondary transfer portion R).

As shown in FIG. 12, the conductive layer 15*b* is heated in the heating region and the temperature Th of the conductive layer 15*b* sharply rises from the room temperature. Because of the thermal resistance of the surface releasing layer 15*c*, the toner temperature Tt rises with a slight delay from the temperature Th of the conductive layer 15*b*. However, since the thickness of the surface releasing layer 15*c* is a thin layer having a thickness of several μm–several tens μm, the delay is several msec–10 msec at the most. When the intermediate transfer belt 15 passes through the heating region, the conductive layer 15*b* is no more heated and hence, the temperature of the conductive layer 15*b* is lowered since the heat thereof is taken away by the surrounding base layers 15*a* and the surface releasing layer 15*c*. The toner temperature continues its elevation until the intermediate transfer belt 15 reaches the transfer and fixing region since there is the heat transfer from the surface releasing layer 15*c* even after the intermediate transfer belt 15 passes through the heating region. At the entrance of the transfer and fixing region, the toner and the intermediate transfer belt 15 are brought into contact with the recording member of a room temperature and hence, the temperature is sharply lowered. In case the toner temperature at a moment that the toner comes into contact with the recording member is lower than the toner softening point temperature, it is necessary to control the heating quantity generated by the electromagnetic induction heating device 22 such that the adhering force which works on an interface between the toner and the recording member becomes more than the toner softening point temperature. Thereafter, as the intermediate transfer belt 15 advances toward the exit of the transfer and fixing region, the toner temperature is continuously lowered and is lowered to or below the softening point temperature. At the exit of the transfer and fixing region, the temperature of the conductive layer 15*b* and the toner temperature are lowered to temperature approximately close to balanced temperature.

In this manner, according to the image recording device of this embodiment, in the heating region which faces the electromagnetic induction heating device 22 in an opposed manner, only the vicinity of the conductive layer 15*b* of the intermediate transfer belt 15 which absorbs the electromagnetic wave is heated, while in the transfer and fixing region, the toner heated and fused at the heating region is brought into pressure contact with the recording member of a room temperature and the transfer and the fixing of the toner are simultaneously performed. Since the intermediate transfer belt 15 is heated merely at a surface thereof, the temperature of the intermediate transfer belt 15 is sharply lowered right after transferring and fixing. Accordingly, the heat storage within the device can be minimized.

On the other hand, in the conventional image recording device which performs transferring and fixing simultaneously, when the device is used continuously, the heat storage occurs and the temperature of the device rises apparently corresponding to the heat storage and hence, the potential characteristics of the photosensitive drum 11 becomes unstable. In particular, lowering of the charged potential becomes apparent and hence, in case an inverted developing is used as the toner image forming method, for example, a surface fogging occurs on a back ground portion thus making the deterioration of the image quality apparent. Furthermore, along with the temperature elevation of the device, the toner is fused in the vicinity of the developing device and a phenomenon that the toner is adhered to a cleaning blade is observed.

To the contrary, according to the image recording device of this embodiment, the temperature elevation of the inside of the device at the time of continuous operation is far smaller than that of the conventional method and hence, the characteristics of the photosensitive drum 11, the toner or the like are not changed. Accordingly, even when the image recording device is used for a long period, the degradation of the image is hardly found and the high quality image can be obtained in a stable manner. This effect is particularly apparent in forming color images.

As described heretofore, the image forming device according to this embodiment has following specific advantages.

The vicinity of the surface of the intermediate transfer belt 15 is directly heated by the electromagnetic induction heating device 22 and hence, the toner can be rapidly heated without being influenced by the thermal conductivity and the heat capacity of the substrate layer 15*a* of the intermediate transfer belt 15.

Furthermore, heating of the toner does not depend on the thickness of the intermediate transfer belt 15 and hence, in case the rigidity of the intermediate transfer belt 15 must be increased to enable a high speed driving, even when the substrate layer (substrate member) of the intermediate transfer belt 15 is made thicker, the toner can be rapidly heated to the fixing temperature.

The substrate layer of the intermediate transfer belt 15 is made of resin having a low thermal conductivity and hence, it exhibits a favorable heat insulation thus minimizing the heat loss even when printing is performed continuously. Furthermore, in case the region where no image exists, for example, the non-image portion which is defined between the recording members continuously supplied passes through the heating region A, by controlling the exciting circuit 223, a wasteful heating can be stopped thus remarkably enhancing the energy efficiency together with other improvements. Furthermore, the temperature elevation of the inside of the device can be suppressed by an amount of enhancement of the thermal efficiency so that the change of the characteristics of the photosensitive drum and the adhesion of the toner to the cleaning member or the like can be prevented.

Furthermore, according to this electromagnetic induction heating device 22, at the time of feeding the recording member of the small size such as the envelope, the movable cores of the core blocks 221(1), 221(4) disposed at both left and right ends are moved by a distance s (for example, 4 mm) so that the concentration of the magnetic flux is obviated and only the envelope size portion is heated thus reducing the power consumption and suppressing the temperature elevation of the inside of the device.

Accordingly, there is an advantage that the thermal influence to the photosensitive drum 11 can be reduced.

Figure 13:
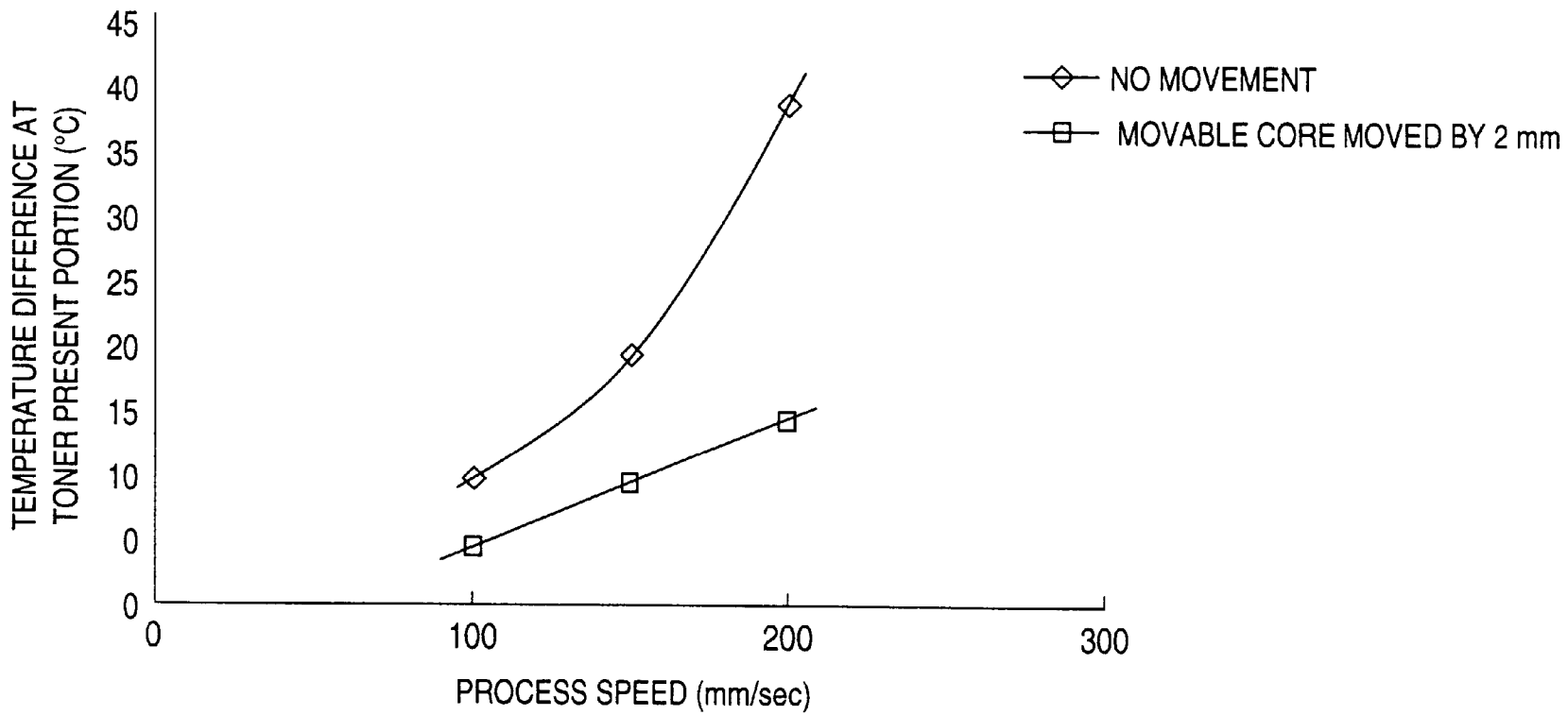
FIG. 13 is an explanatory view showing the temperature difference at a toner presence part during moving of the movable core.

For example, as shown in FIG. 13, in case the movable core 224 is moved at a given process speed by 2 mm and the temperature difference between the toner present portion and the toner non-present portion is detected, it is confirmed that the mode in which the movable core 224 is retracted can reduce the temperature difference at the toner present portion more efficiently than the mode in which the movable core 224 is not retracted.

Furthermore, conventionally, irrespective of the distribution region of the image, the energy equal to energy necessary for transferring and fixing the toner image formed on the entire surface has been always consumed. To the contrary, according to this embodiment, with the provision of divided exciting coil units, the energy consumption at the non-image portion can be obviated and hence, there is an advantage that the electric power can be supplied corresponding to the image to be formed thus realizing a further reduction of the power consumption.

In the above embodiment, an example in which all toner images of four colors are transferred to the intermediate transfer belt 15 and then the toner images are heated and fused by the electromagnetic induction heating device 22 is shown. However, respective toner images may be heated and fused one by one after being transferred by means of primary transfer so as to temporarily fix the toner image on the intermediate transfer belt 15 is used. Due to such a method, there is an advantage that a phenomenon that after the primary transfer operation, overlapped toner images in four colors are disturbed can be prevented and the resist and the magnification of the image can be finely adjusted.

In the above-mentioned embodiment, as the transfer method at the primary transfer portion Q, the electrostatic transfer method in which a biased roller having an insulated dielectric layer is used and the toner image is electrostatically transferred onto the intermediate transfer belt 15. However, the adhesion transfer method in which the heat-resistant intermediate transfer belt 15 having a resiliency is used and the primary transfer roller 16 is pushed toward the photosensitive drum 11 from the inside of the intermediate transfer belt 15 and the toner image is transferred to the intermediate transfer belt 15 can be used. In this case, a slight amount of toner remains on the photosensitive drum 11 after transferring and hence, a static energy held by a residual toner has to be eliminated and cleaned by means of the static eliminating eliminator 18 and the cleaning device 17 respectively.

Second Embodiment

Figure 14:
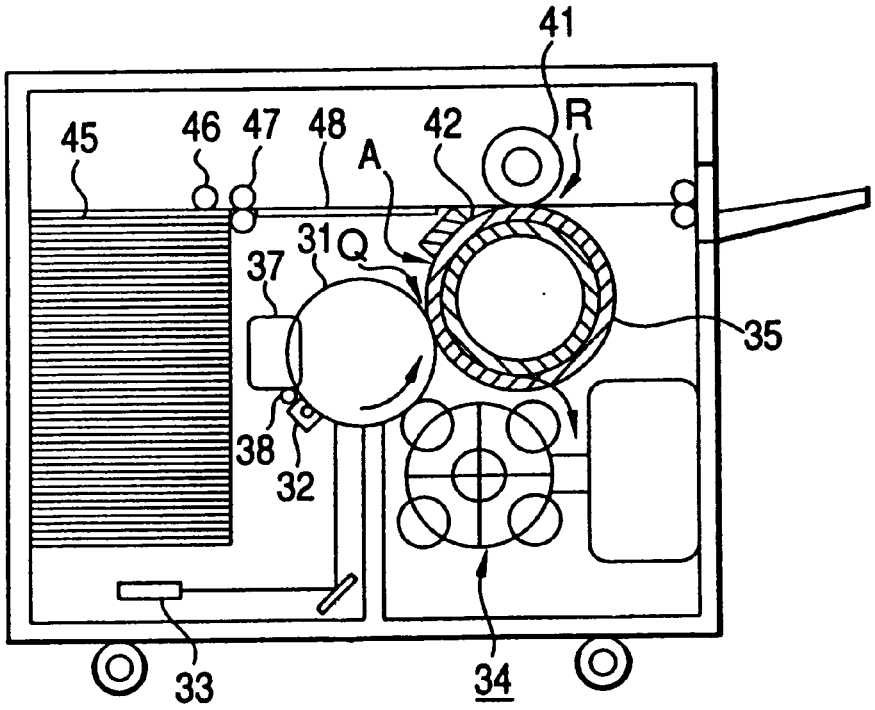
FIG. 14 is an explanatory view showing the schematic construction of the imager recording device according to the second embodiment.

FIG. 14 is a schematic structural view showing an image recording device of the second embodiment.

As shown in the drawing, this image recording device, as in the case of the first embodiment, includes a photosensitive drum 31, a charging device 32, a laser scanner 33, a rotary developing device 34, a cleaning device 37, a static eliminating lamp 38, a pressure roller 41, a paper feeder 45, a paper feed roller 46, a resist roller 47 and a recording member guide 48 and the like. However, different from the first embodiment, in place of the intermediate transfer belt 15, an intermediate transfer drum 35 is provided. Furthermore, at the upstream side of a secondary transfer portion Y in a toner image convey direction of the intermediate transfer drum 35, an electromagnetic induction heating device 42 is disposed in such a manner that the device 42 faces the outer peripheral surface of the intermediate transfer drum 35 in an closely opposed manner.

Figure 15:
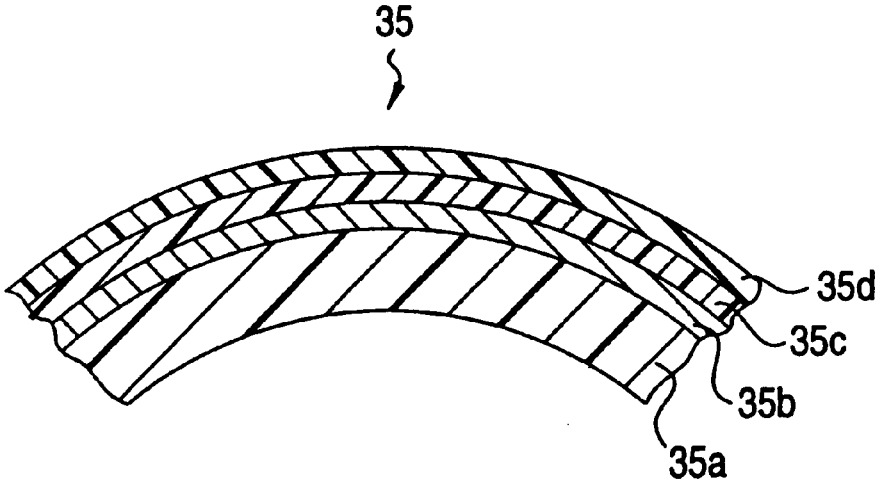
FIG. 15 is a schematic cross sectional view of an intermediate transfer drum used in the above-mentioned image recording device.

As shown in FIG. 15, the intermediate transfer drum 35 is provided with a conductive layer 35*b* formed by laminating a nickel plating layer having a thickness of 5 μm on a heat insulating substrate member roller 35*a* made of a porous ceramic, a releasing layer 35*c* formed by laminating a silicone rubber having a thickness of 30 μm on the conductive layer 35*b*, and a heat resistant resin layer 35*d* made of polyimide which constitutes an uppermost layer and has a thickness of 20/μm.

In the above-mentioned electromagnetic induction heating device 42, as in the case of the device shown in FIG. 4, by applying an alternating current to the exciting coil 222 from the exciting circuit 223, a conductive layer 35*b* of an intermediate transfer drum 35 is made to generate heat due to an electromagnetic induction heating.

Figure 16:
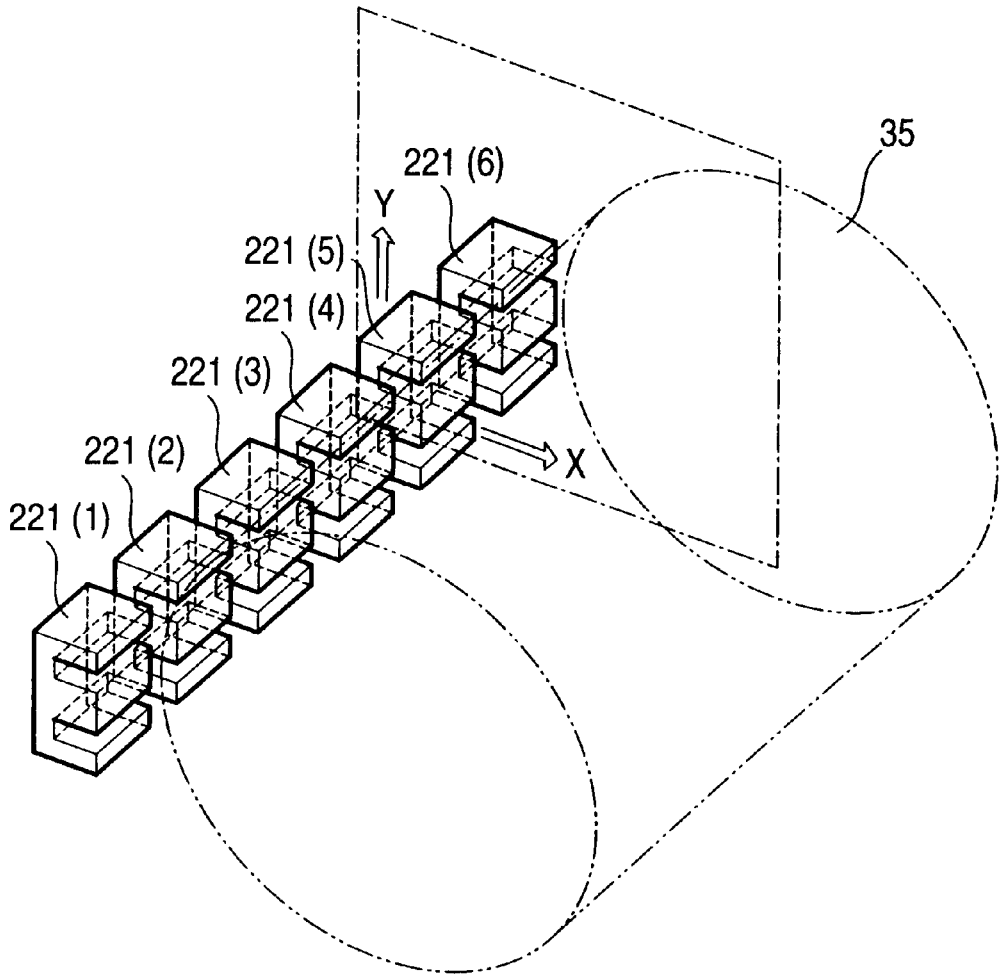
FIG. 16 is an explanatory view showing the detail of the electromagnetic induction heating device used in the second embodiment.

In particular, according to this embodiment, as shown in FIG. 16, for example, the electromagnetic induction heating device 42 is constructed in such a manner that an iron core 221 (magnetic core) which constitutes magnetic field generating unit is divided into a plurality (six in this embodiment) of core blocks 221(1)–221(6) within a given size in a direction which intersects a longitudinal direction, that is, the moving direction of the intermediate transfer drum 35. In FIG. 16, the exciting coils and the like are omitted.

Among these core blocks 221(1)–221(6), each one of core blocks 221(1), 221(2), 221(5), 221(6) which are remained after excluding the two central core blocks 221(3), 221(4) is composed of a central core portion where the magnetic flux is concentrated and peripheral core positions positioned at back surface sides of the central core portion, wherein these core portions are formed as rectangular parallelepiped movable cores 224 which are movable in frontward and backward directions independently.

Figure 17:
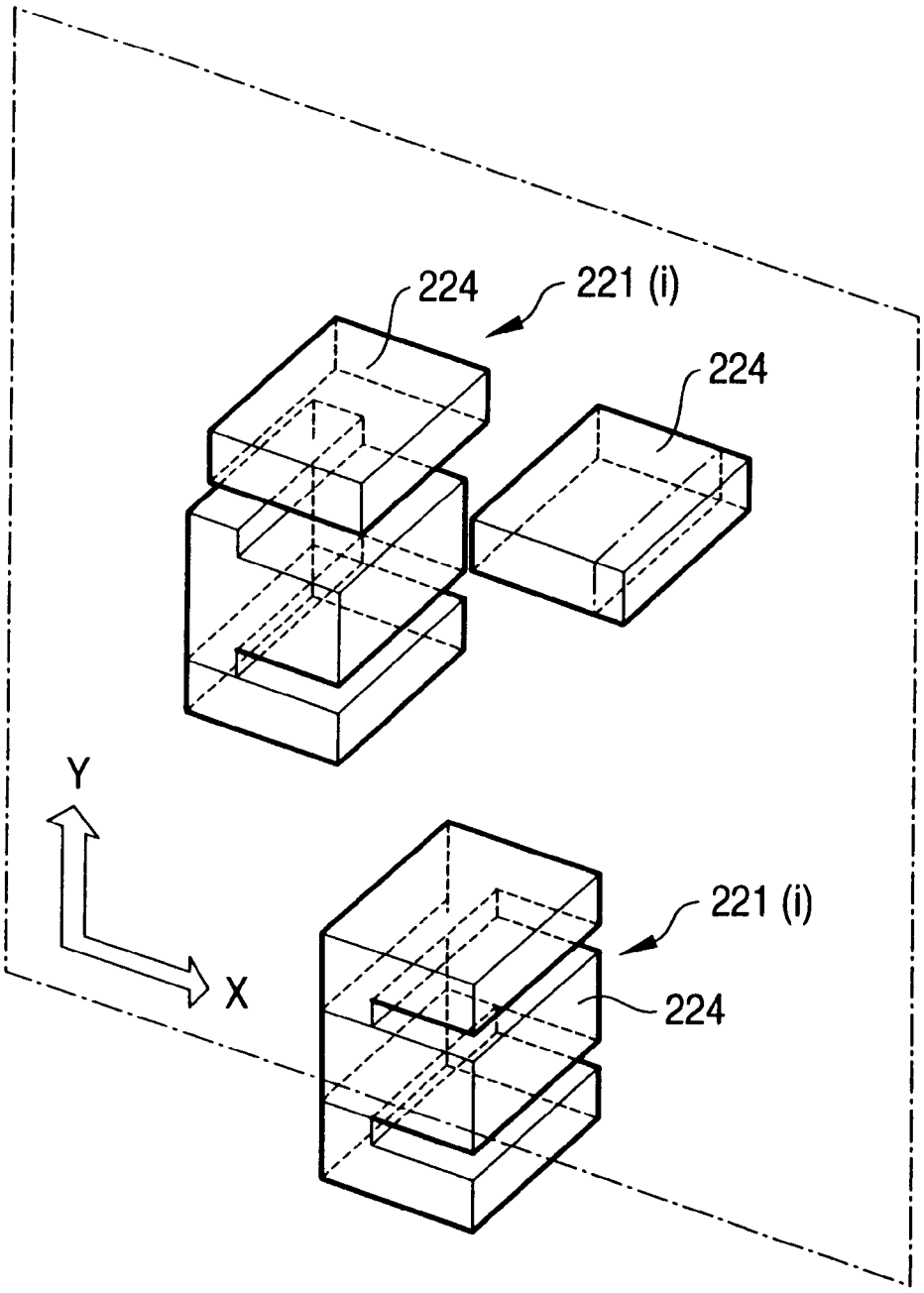
FIG. 17 is an explanatory view showing the construction of the movable core of the core block.

In this embodiment and the first embodiment, as illustrated at the lower side of FIG. 17, the central core portion of the core block **221(*i*) (i=1, 2, 5, 6) and peripheral core portions which are positioned at the back sides of the central core portion constitute one movable core 224. However, the core block 221(*i*) is not limited to such a structure and any structure can be properly selected. For example, as illustrated at the upper side of FIG. 17, the upper and lower peripheral core portions of the core blocks 221(*i*) (i=1, 2, 5, 6) are formed as movable cores 224 and they are moved in an X direction or in a direction which is perpendicular to X, Y directions, or the whole core block 221(*i*) is moved as the movable core 224**.

Figure 18:
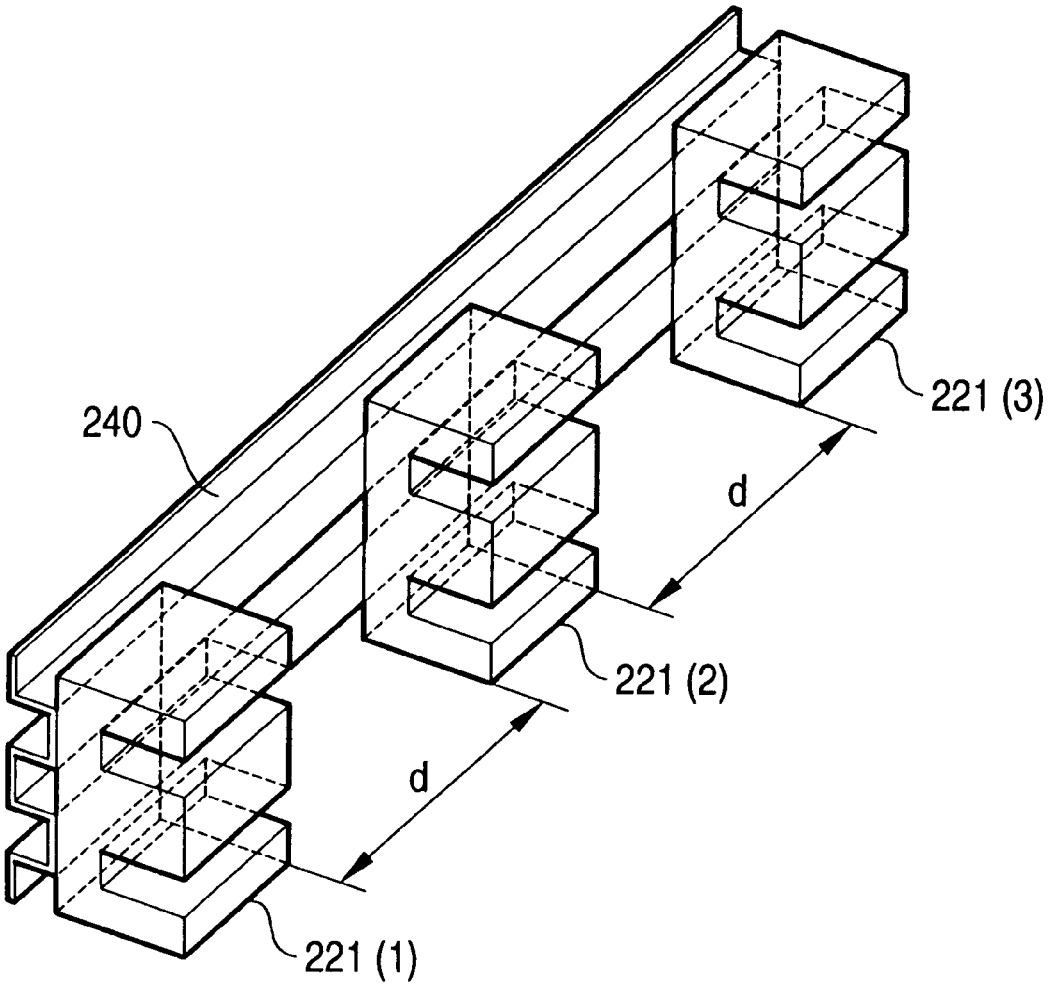
FIG. 18 is an explanatory view showing a modification of the electromagnetic induction heating device used in the second embodiment.

Furthermore, in this embodiment and the first embodiment, the core blocks **221(*i*) (i=1–6) are arranged relatively close to each other or densely. The arrangement, however, is not limited to such an arrangement. As shown in FIG. 18, the core blocks 221(1)–221(3) may be arranged on a support panel 240 with a suitable distance d. However, in arranging core blocks 221(1)–221(3) with the suitable distance d, it is necessary to prevent the deterioration of the heating ability at the portions where the core block 221(*i*)** is not present.

In such an image recording device, only the vicinity of the surface of the intermediate transfer drum 35 which has a conductive layer 35*b* is heated by the electromagnetic induction heating device 42 and hence, the toner on the intermediate transfer drum 35 is approximately momentarily heated and fused.

Furthermore, the intermediate transfer drum 35 is only partially heated and hence, the fused toner is sharply cooled when the fused toner comes into contact with the recording member of a room temperature at the secondary transfer portion Y. That is, the fused toner is brought into pressure contact with the recording member at the nip of the secondary transfer portion Y and hence, the fused toner is momentarily transferred and fixed, and thereafter is cooled during being conveyed toward the exit of the nip. At the exit of the nip, the toner temperature is sufficiently lowered so that the cohesive force of the toner is large and accordingly the toner image can be almost perfectly and directly transferred and fixed onto the recording member without causing an offset.

In the above-mentioned electromagnetic induction heating device 42, the vicinity of the surface of the intermediate transfer drum 35 can be rapidly selectively heated and hence, even when the intermediate transfer drum roller 35 is a roller having a large heat capacity, the toner image can be rapidly heated to the softening point temperature and accordingly the image recording device having an excellent thermal efficiency can be realized.

Embodiment 3

Figure 19:
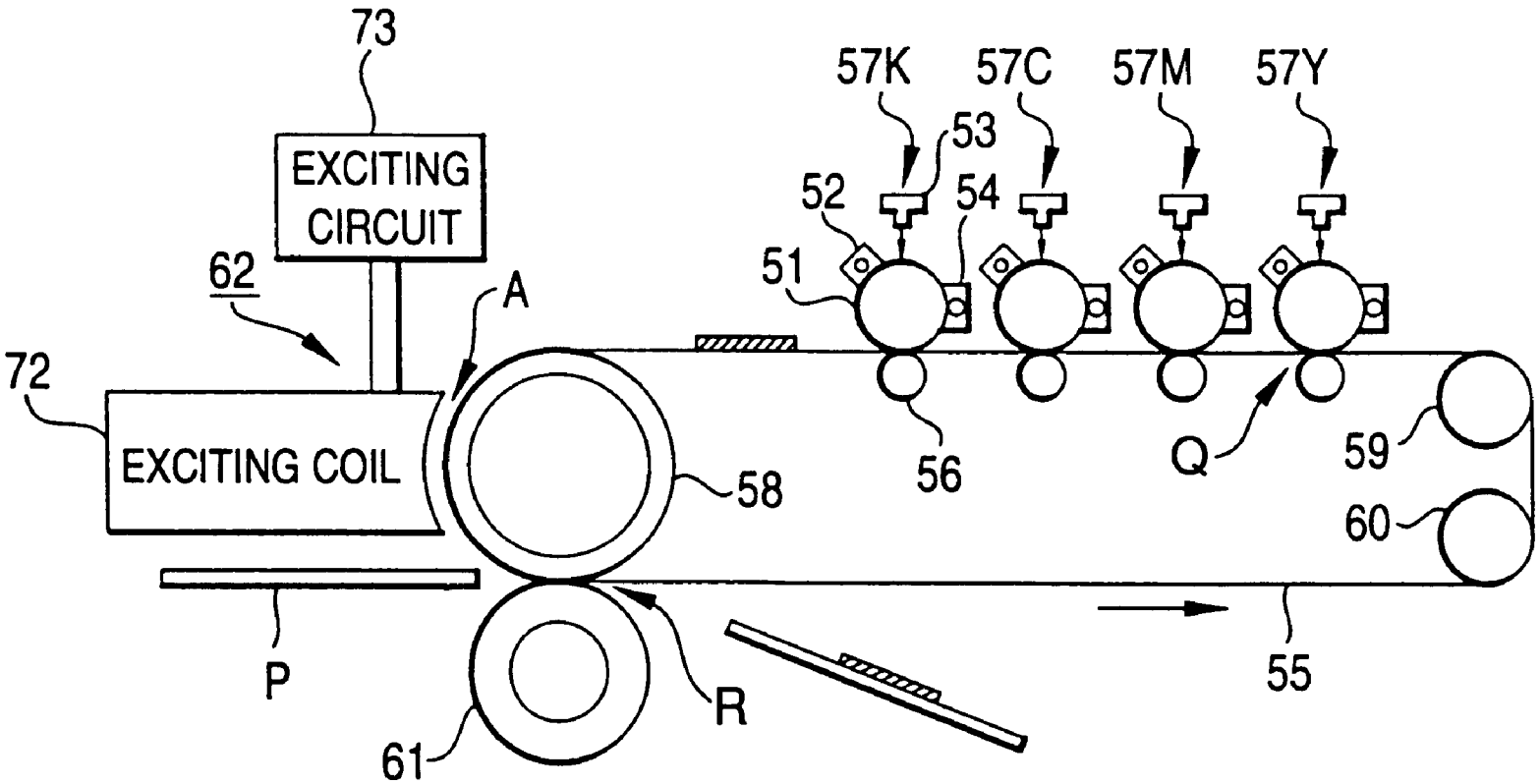
FIG. 19 is a schematic structural view showing an image recording device according to the embodiment 3.

FIG. 19 is a schematic structural view showing an image recording device according to the embodiment 3.

In the drawing, this image recording device is provided with an intermediate transfer belt 55 having a peripheral surface which performs a circulatory movement and four sets of image forming units 57Y, 57M, 57C, 57K which form toner images of yellow, magenta, cyan and black respectively are disposed at positions where these units face the intermediate transfer belt 55 in an opposed manner. Each image forming unit 57Y–57K includes, as in the case of the first embodiment, a photosensitive drum 51 which has a surface on which an electrostatic latent image is formed, a charging device 52 which substantially uniformly charges the surface of the photosensitive drum 51, an exposure device 53 which irradiates laser beams to the photosensitive drum 51 so as to form the latent image, a developing device 54 which selectively transfers the toner to the latent image on the photosensitive drum 51 so as to form a toner image, and a primary transfer roller 56 which is disposed in such a manner that it faces the photosensitive drum 51 in an opposed manner with the intermediate transfer belt 55 sandwiched between them and transfers the toner image on the photosensitive drum 51 onto the intermediate transfer belt 55.

At the inner side of the intermediate transfer belt 55, a secondary transfer roller 58, a driving roller 59 and a take-up roller 60 are disposed and the intermediate transfer belt 55 is wound around these rollers in such a manner that the intermediate transfer belt 55 is capable of circulating. At the downstream of the respective image forming units in a circulating direction of the intermediate transfer belt 55, a pressure roller 61 which pushes the intermediate transfer belt 55 to a secondary transfer roller 58 side is provided. To a secondary transfer portion R where the intermediate transfer belt 55 and the pressure roller 61 are brought into pressure contact with each other, a recording member P is fed by means of convey unit not shown in drawings. The construction of the intermediate transfer belt 55 is, as in the case of the intermediate transfer belt 15 shown in FIG. 3, made of a three-layered structure consisting of a base layer, a conductive layer and a surface releasing layer.

Furthermore, at the upstream side of the secondary transfer portion R in a circulating direction of the intermediate transfer belt 55, an electromagnetic induction heating device 62 which heats the toner image transferred onto the intermediate transfer belt 55 is provided. This electromagnetic induction heating device 62 is, as in the case of the device shown in FIG. 4, provided with an exciting coil 72, an exciting circuit 73 and the like and the conductive layer of the intermediate transfer belt 55 is made to generate heat due to an electromagnetic induction heating.

In such an image recording device, the image information is decomposed to images of four colors consisting of cyan (C), magenta (M), yellow (Y) and black (B) and toner images which differ in color respectively are formed on the photosensitive drum 51 by means of respective image forming units 57Y, 57M, 57C, 57K. The intermediate transfer belt 55 is circulating in a given direction and the toner image is transferred to the intermediate transfer belt 55 from the photosensitive drum 51 at the primary transfer portion Q. Toner images are tranferred in sequence by means of four image forming units 57Y–57K and thereafter, along with the movement of the intermediate transfer belt 55, four overlapped toner images are conveyed to a heating region A where the toner images face the electromagnetic induction heating device 62 in an opposed manner.

In this heating region A, four toner images on the intermediate transfer belt 55 are fused by the generated heat of the conductive layer produced by electromagnetic induction heating. Then, the fused toner is brought into pressure contact with the recording member P of a room temperature at the secondary transfer portion R and hence, the toner image is momentarily impregnated into the recording member P thus completing transferring and fixing and then the toner image is cooled while being conveyed to the exit of the nip. At the exit of the nip, the temperature of the toner is sufficiently lowered and hence, the cohesive force of the toner is large so that the toner image is substantially completely transferred and fixed onto the recording member P without causing an offset.

The above-mentioned device of a tandem system which arranges four image forming units 57Y–57K has a productivity four times greater than that of the device of the first embodiment which adopts the system rotating the photosensitive drum 11 in four cycles and also can obtain the color image at high speed. However, in case of the four cycle system, transferring and fixing of the toner image onto the recording member is performed once in four cycles, while, in case of the tandem system, the recording member is supplied continuously and hence, the thermal load to the intermediate transfer belt 55 is increased and a problem that the temperature of the photosensitive drum 51 is elevated is apt to occur. Accordingly, it has been considerably difficult for the conventional device adopting the tandem system to solve this problem. However, according to the image recording device of this embodiment, the intermediate transfer belt 55 can be selectively and partially heated by means of the electromagnetic induction heating device 62 and hence, there is an advantage that even when the image is formed at a high speed, the thermal storage hardly occurs. Furthermore, the toner image on the intermediate transfer belt 55 can be rapidly heated thus suppressing the consumption energy.

Embodiment 4

Figure 20:
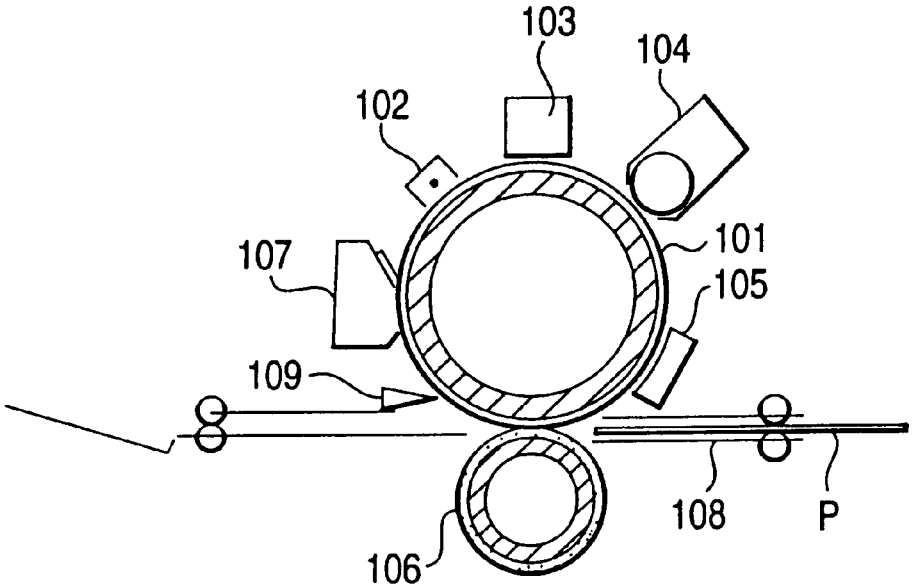
FIG. 20 is a schematic structural view showing an image recording device according to the embodiment 4.

FIG. 20 is a schematic structural view showing an image recording device according to the embodiment 4.

In the drawing, this image recording device adopts a system which directly performs transferring and fixing of a toner image onto a recording member from a recording drum 101 without performing a primary transfer of the toner image developed on the recording drum 101. The image recording device uses an ionography as latent image forming unit. Around the recording drum 101, this image recording device is provided with a charging device 102 which substantially uniformly charges the surface of the recording drum 101, a recording head 103 which applies corona ion beams to the recording drum 101 so as to form a latent image on the recording drum 101, a developing device 104 which develops the latent image formed on the recording drum 101 by applying the toner to the latent image, an electromagnetic induction heating device 105 which fuses the developed toner image by heating, a pressure roller 106 which brings the fused toner image into pressure contact with a recording member P which is fed along a recording member guide 108, a peel-off pawl 109 which peels off the recording member P from the recording drum 101, and a cleaning device 107 which cleans the toner on the recording drum 101.

Since the toner image is directly heated by and fused to the surface of the recording drum 101, the recording drum 101 is required to have the heat resistance and the toner releasing ability and an insulating recording drum is adopted to meet such requirements.

Figure 21:
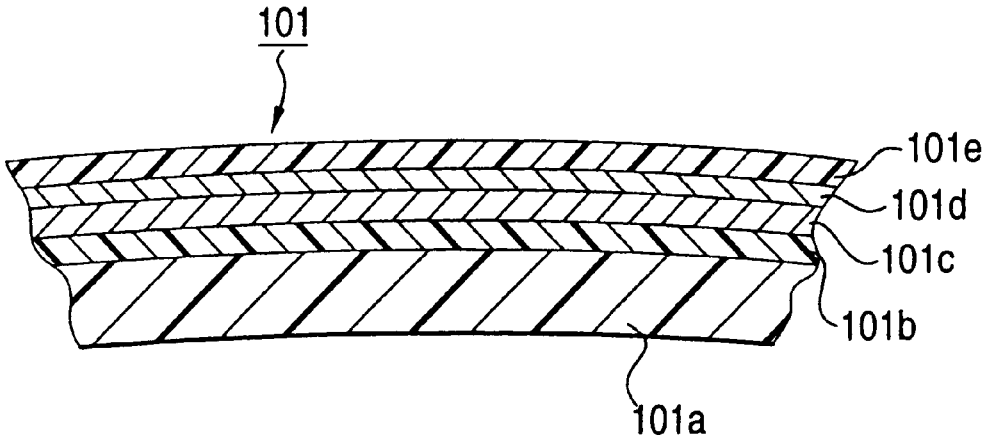
FIG. 21 is a schematic cross sectional view of a photosensitive drum used in the above-mentioned image recording device.

In this embodiment, as shown in FIG. 21, on a peripheral surface of a base member roller 101*a,* the recording drum 101 is provided with a heat insulating layer 101*b,* a base layer 101*c* which is laminated on the heat insulating layer 101*b* and has a thickness of 1 $\mu$m–50 $\mu$m, a conductive layer 101*d* which is laminated on the base layer 101*c* and has a thickness of 1 $\mu$m–50 $\mu$m and a recording layer 101*e* which forms an uppermost layer and has a thickness of 1 $\mu$m–100 $\mu$m. As the heat insulating layer 101*b*, material having a heat conductivity of not more than 5 $10^{-4}$ cal/sec.cm.sec such as a foamed body made of organic material or inorganic material, ceramics, cellulose or the like, for example, can be used. As the base layer 101*c*, polyimide, polyamideimide or the like, for example, can be used. As the conductive layer 101*d*, material having intrinsic volumetric resistivity of not less than $5\times 10^{-8}$ Ωm such as nickel, iron, cobalt, aluminum, copper or the like, for example, can be used. As the recording layer 101*e*, material having resistivity of not less than $10^{12}$ Ωcm and a dielectric constant of 1.5–40 such as polytetrafluoroethylene (dielectric constant 2–3) and other fluorocarbon polymer, silicone rubber (dielectric constant 2.6–3.3) or the like, for example, can be used.

The pressure roller 106 is made of a resilient roller which is coated by a heat resistant resilient body such as silicone rubber, fluoro-rubber or the like.

The recording head 103 is of a stylus type which arranges a large number of needle electrodes ( degree of pit of 300 dpi in this embodiment) on each pixel and charging is selectively performed from the needle electrodes in response to image signals, wherein ion beams generated by this charging are adhered to the recording drum so as to form an electrostatic latent image.

In this image recording device, the recording drum 101 is substantially uniformly charged by the charging device 102 and thereafter, the electrostatic latent image is formed on the recording drum 101 by the irradiation of the ion beams from the recording head 103, and this electrostatic latent image is developed by the developing device 104. Then, the conductive layer 101*d* of the recording drum 101 is made to generate heat by means of the electromagnetic induction heating device 105 and hence, the toner image on the recording drum 101 is fused by heating. The fused toner image is brought into pressure contact with a recording member P of a room temperature by the pressure roller 106 so that toner image is transferred and fixed onto the recording member P simultaneously.

According to such an image recording device, the recording drum 101 is partially heated by means of the electromagnetic induction heating device 105 and hence, the energy consumption of the device as a whole can be reduced. Furthermore, an intermediate transfer body is not necessary in this system and hence, advantages that steps necessary of image recording can be simplified and the device is miniaturized can be obtained.

As recording heads which emits ion beams in response to image data, various systems are considered. For example, in place of the above-mentioned recording head 103, an ion projection system in which ion generated due to a corona discharge in an ion generating chamber is projected from a fine nozzle based on the image data as ion beams can be used.

As has been described heretofore, according to the electromagnetic induction heating device of the present invention, by making the movable core perform a relative movement to the object to be heated, the intensity of the fluctuation magnetic field from the magnetic core is changed, and due to such a change, the eddy current in the electromagnetic induction heat generating layer is changed so that an amount of heat generation can be changed. Accordingly, without performing an enegization control of exciting coils by the exciting circuit, the generated heat distribution on the object to be heated can be easily adjusted so that the object to be heated can be always held in a favorable heated condition and the energy consumption can be effectively reduced.

In particular, according to the present invention, in case the magnetic core is divided into a plurality of blocks and at least one of core blocks is provided with a movable core, the heat generation on a partial heat generating region of the object to be heated can be adjusted with an extreme simplicity.

Furthermore, according to the image recording device of the present invention, the fluctuation magnetic field is applied to the electromagnetic induction heat generating layer disposed in the vicinity of the peripheral surface of the image carrying body and the heat energy is given to the toner making use of the generated heat due to the eddy current generated in the electromagnetic induction heat generating layer and hence, the vicinity of the peripheral surface of the image carrying body is selectively heated so as to fuse the unfixed layer (toner image) so that the storage of heat within the device due to temperature elevation of the image carrying body can be prevented.

Accordingly, the stable outputted image can be obtained without giving rise to the change of characteristics of the image carrying body.

Furthermore, the image recording device according to the present invention exhibits an excellent heat energy utilization efficiency and hence, the energy consumption of the device as a whole can be reduced, and the high speed image forming with a limited electric power becomes possible. Furthermore, a warm-up time can be substantially eliminated and hence, an electric power which has been supplied for holding the heating member at a predetermined temperature at the standby condition of the device can be omitted.

Still furthermore, at the time of transferring and fixing, the recording member works as a cooling member and the temperature of the image carrying body is sharply lowered, a large-sized cooler is not necessary thus realizing the miniaturization of the device as a whole. Furthermore, the heating quantity of the recording member is so small that the transfer and fixing characteristics is hardly influenced by the thickness and the heat capacity of the recording member and hence, setting of various conditions of the device is facilitated and no curling or wrinkle occurs on the recording member.

In particular, in case the magnetic core of the electromagnetic induction heating device is divided into a plurality of blocks and the movable core is provided to at least one of the core blocks and the image carrying body is heated corresponding to the size of the recording member, the heat generating area of necessity minimum can be defined corresponding to the image size and the partial heating of only portions where images are formed can be easily realized.

What I claim is:

1. An electromagnetic induction heating device which heats an object to be heated which has at least an electromagnetic induction heat generating layer, comprising:

a magnetic core made of magnetic material which is disposed facing the electromagnetic induction heat generating layer of the object to be heated;

an exciting coil which is wound around the magnetic core and generates a fluctuation magnetic field which penetrates the electromagnetic induction heat generating layer; and a movable core provided to at least a portion of the magnetic core which can move relative to the object to be heated and can change the intensity of the fluctuation magnetic field.

2. The electromagnetic induction heating device according to claim 1, wherein the magnetic core is divided into a plurality of blocks and the movable core is provided to at least one of the core blocks.

3. The electromagnetic induction heating device according to claim 2, wherein the magnetic core has an E-shaped cross section which opens facing the electromagnetic induction heat generating layer, and the exciting coil is wound around a central core portion of the magnetic core.

4. The electromagnetic induction heating device according to claim 2, wherein the exciting coil is wound around at least two of the plurality of blocks collectively.

5. The electromagnetic induction heating device according to claim 1, wherein the magnetic core has an E-shaped cross section which opens facing the electromagnetic induction heat generating layer, and the exciting coil is wound around a central core portion of the magnetic core.

6. An image recording device, comprising:

an image carrying body which is provided with an electromagnetic induction heat generating layer and carries and conveys an unfixed image;

an image forming unit which forms the unfixed image carried on the image carrying body;

an electromagnetic induction heating device according to claim 1 which is disposed facing the image carrying body in a direction perpendicular to a moving direction of the image carrying body and fuses the unfixed image on the image carrying body by heating the image carrying body with electromagnetic induction heating; and a fixing unit which is disposed at a downstream position from a portion of the image carrying body facing the electromagnetic induction heating device and transfers and fixes the fused unfixed image on the image carrying body to a recording member.

7. The image recording device according to claim 6, wherein the electromagnetic induction heating device includes the magnetic core which is divided into a plurality of blocks and the movable core is provided to at least one of the core blocks and heats the image carrying body substantially corresponding to a size of the recording member which passes through the fixing unit.

8. The image recording device according to claim 6, wherein the image carrying body includes a base layer, the electromagnetic induction heat generating layer laminated on the base layer, and a resilient releasing layer laminated on the electromagnetic induction heat generating layer.

* * * * *